US006569587B2

(12) United States Patent
Sasaki et al.

(10) Patent No.: US 6,569,587 B2
(45) Date of Patent: May 27, 2003

(54) PHOTOSENSITIVE BODY FOR ELECTROPHOTOGRAPHY AND MANUFACTURING METHOD FOR THE SAME

(75) Inventors: Teruo Sasaki, Nagano (JP); Kenichi Hara, Nagano (JP); Shinjiro Suzuki, Nagano (JP); Yoichi Nakamura, Nagano (JP); Hideki Kina, Nagano (JP)

(73) Assignee: Fuji Electric Imaging Co., Ltd., Nagano (JP)

( * ) Notice: Subject to any disclaimer, the term of this patent is extended or adjusted under 35 U.S.C. 154(b) by 0 days.

(21) Appl. No.: 09/769,020

(22) Filed: Jan. 25, 2001

(65) Prior Publication Data

US 2001/0031409 A1 Oct. 18, 2001

Related U.S. Application Data

(63) Continuation-in-part of application No. 09/490,969, filed on Jan. 24, 2000.

(30) Foreign Application Priority Data

Jan. 29, 1999 (JP) ..... 11-022497
Jan. 27, 2000 (JP) ..... 2000-018589

(51) Int. Cl.[7] ..... G03G 5/06

(52) U.S. Cl. ..... 430/78; 430/56; 430/59.4; 430/59.5; 430/133

(58) Field of Search ..... 430/59.5, 59.4, 430/78, 56, 133, 83

(56) References Cited

U.S. PATENT DOCUMENTS 5,418,107 A * 5/1995 Nealey et al. ..... 430/132
5,466,796 A * 11/1995 Burt et al. ..... 540/139
5,521,306 A * 5/1996 Burt et al. ..... 540/141
5,910,384 A * 6/1999 Yamasaki et al. ..... 430/78

FOREIGN PATENT DOCUMENTS

EP 798346 * 1/1997
JP 2-280169 * 11/1990 ..... 430/78

OTHER PUBLICATIONS

US Patent & Trademark English–Language Translation of JP 2–280169 (pub Nov. 1990).*
Grant, R. et al. eds. *Grant & Hackh's Chemical Dictionary*, Fifth Edition, McGraw–Hill Book Co, NY (1987), pp 594 & 558.*
Capobianchi, A., et al., *Inorg. Chem.* 32(21), (1993), pp. 4605–4611.*

* cited by examiner

*Primary Examiner*—Janis L. Dote
(74) *Attorney, Agent, or Firm*—Darby & Darby

(57) ABSTRACT

An electrophotographic photosensitive body has a photosensitive layer formed on a conductive substrate. The photosensitive layer contains a phthalocyanine compound as a photoconductive material, wherein the content of a phthalocyanine dimer compound in the layer that contains the phthalocyanine compound is present from about 100 nmol to about 300 mmol per 1 mol of the phthalocyanine compound. The resulting electrophotographic photosensitive body has excellent potential retention properties.

27 Claims, 2 Drawing Sheets

PHOTOSENSITIVE BODY FOR ELECTROPHOTOGRAPHY AND MANUFACTURING METHOD FOR THE SAME

The present application is a continuation-in-part of U.S. patent application Ser. No. 09/490,969, filed Jan. 24, 2000 abandoned, the contents of which are herein incorporated by reference.

BACKGROUND TO THE PRESENT INVENTION

The present invention relates to a photosensitive body for electrophotography (henceforth may be referred to as simply "photosensitive body") and a manufacturing method for the same. Described in more detail, the present invention relates to an electrophotography photosensitive body and a manufacturing method for the same, having an excellent retention rate due to an improvement of photoconductive materials in a photosensitive layer that is provided on top of a conductive substrate and that contains organic material. The present invention is used in electrophotographic printers, copiers, facsimiles, and the like.

Electrophotography photosensitive bodies must have a function for retaining surface charge in the dark, a function for receiving light and generating charge, and a function for similarly receiving light and transporting the charge. In a single-layer photosensitive body, all of these functions are combined in one layer. In a laminated photosensitive body, layers in which the functions are separated mainly between a layer that contributes to charge generation and a layer that contributes to surface charge retention in the dark and charge transport during light receiving times are laminated.

In order to form the image by an electrophotography method using an electrophotography photosensitive body, a Carlson method is used, for example. This method of image formation is conducted as follows: the photosensitive body is charged by corona discharge in the dark; an electrostatic latent image of text or pictures from the original is formed on the charged surface of the photosensitive body; the electrostatic latent image that is formed is developed by the toner; the toner image that is developed is transferred and fixed onto a support body such as paper and the like. After transferring the toner image, and after removing the charge and removing residual toner and conducting photo discharge, the photosensitive body is ready for reuse.

In the prior art, inorganic photoconductive materials such as selenium, selenium alloy, zinc oxide, or cadmium sulfide, and the like dispersed in a resin binding agent, as well as organic photoconductive materials such as poly-N-vinyl carbazole, polyvinyl anthracene, phthalocyanine compounds or bis azo compounds, and the like dispersed in resin binding agents or vacuum deposited have been used for the photosensitive material of the electrophotography photosensitive body as described above.

Of these organic photoconductive materials, various studies have been done on the purification of phthalocyanine compounds. Of these, mu oxo dimers and mu dimers of phthalocyanines that have, in the center, an element that can have an oxidation state of an oxidation number of +3 or greater (henceforth referred to as "multi-oxidative element-containing phthalocyanine") are already known. They are described in Phthalocyanines, C. C. Leznoff et al, 1989 (VCH Publishers, Inc.) and the like.

Furthermore, the following references describe 29H, 31H-phthalocyanine titanyl complexes, Capobianchi, A. et al, Sens. Actuators, B (1998), B48 (1~3), 333~338, and Scrocco, Marisa et al, Inorg. Chem, (1996), 35 (16), 4788~4790.

In addition, the following are reported as phthalocyanine dimer compounds having constructions comprising two phthalocyanine rings that are joined via at least one carbon atom, nitrogen atom, or oxygen atom, and a titanium atom: 7, 12:13, 58:22, 27;28, 38-tetraimino-15, 20:30, 5-dinitrilo-12, 28:27, 13-bis (nitrilo isoindole [3] iliridene nitrilometheno [1,2] benzono) tentrabenzo [c, h, n, s] [1,6,12,17] tetraazacyclodocosyne, titanium (+1) derivative, 7,12:13, 58:22, 27;28, 38-tetraimino-15, 20:30, 5-dinitrilo-12, 28;27, 13-bis(nitrilo isoindole [3] iliridene nitrilometheno [1, 2] benzono) tetrabenzo [c, h, n, s][1, 6, 12, 17] tetraazacyclodocosyne, titanyl complex (henceforth abbreviated as "tetraazacyclodocosyne complex"). These compounds are described in the following references, Capobianchi, A. et al. Inorg. Chem. (1993), 32 (21), 4605~11, Ercolani, Claudio et al, J. Chem. Soc., Dalton Trans. (1990), (6), 1971~7, Baldini, F. et al, Sens. Actuators, B (1998), B51(1~3), 176~180.

As described above, phthalocyanine compounds that contain multi-oxidative elements are known to be used as photosensitive materials for electrophotography photosensitive bodies. Furthermore, various studies have been done with regard to their purification. However, currently, among the impurities contained in multi-oxidative element containing phthalocyanine compounds, the substances that relate to the properties of the electrophotography photosensitive body are not always clear. In other words, although various studies have been presented for various purification methods for multi-oxidative element containing phthalocyanine compounds and for various polymers of phthalonitrile compounds, the relationship between the impurities that are generated during the synthesis of multi-oxidative element containing phthalocyanine compounds and the electrophotography properties, particularly electric potential retention rate, has not always been clear.

OBJECT AND SUMMARY OF THE INVENTION

The object of the present invention is to clarify this relationship, and to provide an electrophotography photosensitive body with excellent electrophotography properties, particularly electric potential retention. A further object of the present invention is to provide a manufacturing method for an electrophotography photosensitive body, wherein when forming a photosensitive layer by a coating solution, a photosensitive layer with excellent electric potential retention can be formed.

The present inventors conducted intensive study in order to solve the above objects. As a result, it was discovered that the electric potential retention rate was greatly increased when, in addition to phthalocyanine, a phthalocyanine dimer compound within a specified content range was included as the photoconductive material in the photosensitive layer on top of the conductive substrate. The electrophotography photosensitive body of the present invention was completed.

In other words, the present invention is a photosensitive body for electrophotography, having a photosensitive layer on top of a conductive substrate, and the photosensitive layer containing a phthalocyanine compound as a photoconductive material, wherein: the layer containing the phthalocyanine compound has a phthalocyanine dimer compound content of about 100 nmol or greater and about 300 mmol or less for every 1 mol of the phthalocyanine compound.

According to a feature of the present invention, the present invention provides an electrophotographic photosensitive body comprising a photosensitve layer which includes titanyl oxo phthalocyanine and its dimer. Matrix assisted laser desorption/ionization time of flight mass spectrometry of the titanyl oxo phthalocyanine and its dimer, which is incorporated in the photosensitive layer, gives at least a first peak having a mass number of 576 and a second peak having a mass number of 1136. The peak integrated intensity of the second peak being from about $10^{-5}$% to about 30% of that of a peak integrated intensity of the first peak.

Furthermore, for the manufacture of the above electrophotography photosensitive body, when a coating solution which contains charge generating material contains a phthalocyanine compound and a phthalocyanine dimer compound and the content of the latter is within a specified range with respect to the former, the photosensitive body using this coating solution was discovered to have a greatly improved electric potential retention rate. As a result, the method of the present invention was completed.

In other words, the present invention is a manufacturing method for the above described electrophotography photosensitive body, having a process for forming a photosensitive layer by coating a coating solution containing a charge generating material on top of a conductive substrate, wherein: the coating solution contains a phthalocyanine compound and a phthalocyanine dimer compound; and the phthalocyanine dimer compound content is about 100 nmol or greater and about 300 mmol or less for every 1 mol of the phthalocyanine compound.

With the present invention, "dimer" also includes multimers in which one or more phthalocyanines are further bonded to a dimer.

The photosensitive layer in the electrophotography photosensitive body of the present invention includes both the single layer type and laminated type and is not limited to either. Furthermore, the above described coating solution in the manufacture method of the present invention can be used with various coating methods such as a dip coating method or a spray coating method and is not limited to either coating method.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Below, referring to the figures, a concrete construction of the photosensitive body of the present invention is described.

In the electrophotography photosensitive body, there are what are called negative charge laminated photosensitive bodies, positive charge laminated photosensitive bodies, and positive charge single layer photosensitive bodies, and the like. The present invention is described below concretely using as an example a negative charge laminated photosensitive body. However, the components and methods and the like for the formation or manufacture of the photosensitive body other than what relates to the phthalocyanine compound of the present invention can be selected as appropriate.

Figure 1:
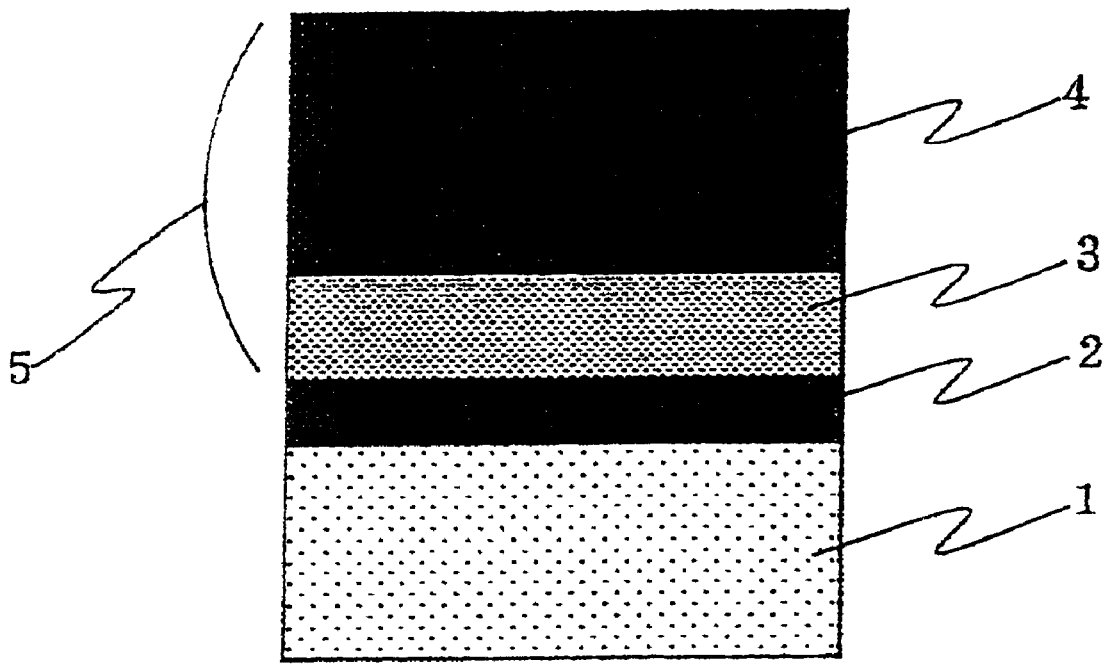
FIG. 1 is a model cross-section diagram of one example of a negative charge laminated electrophotography photosensitive body of the present invention.

Referring to FIG. 1, the negative charge laminated photosensitive body is formed by laminating a photosensitive layer 5 on top of an undercoat layer 2 that is laminated on top of a conductive substrate 1. Photosensitive layer 5 has a charge transport layer 4 layered on top of a charge generating layer 3. Photosensitive layer 5 is a function separated type that is separated between charge generating layer 3 and charge transport layer 4. With either type described above, undercoating layer 2 is not always necessary.

Conductive substrate 1 has the role of an electrode for the photosensitive body and also has the role of a supporting body for each of the other layers. Conductive substrate 1 can be in the shape of a tube, board, or film. In terms of the material, conductive substrate 1 can be a metal such as aluminum, stainless steel, nickel, or alloys of these, or it can be a material that has had conductive treatment on top of glass or resin and the like.

Alcohol soluble polyamides, solvent soluble aromatic polyamides, heat hardening urethane resins, and the like can be used for undercoat layer 2. For the alcohol soluble polyamide, copolymer compounds of nylon 6, nylon 8, nylon 12, nylon 66, nylon 610, nylon 612, and the like, or N-alkyl modified or N-alkoxyl alkyl-modified nylon, and the like are preferred. Concrete examples of these compounds include AMILAN CM8000™ (manufactured by bray Corp. Ltd., 6/66/610/12 nylon copolymer), ELVAMIDE 9061™ (DuPont-Japan Corp. Ltd., 6/66/612 nylon copolymer), DIAMIDE T-170™ (Daicel-Huels Corp. Ltd., nylon 12 main nylon copolymer), and the like. Furthermore, undercoat layer 2 can contain inorganic fine powders and the like of titanium oxide ($TiO_2$), $SnO_2$, alumina, calcium carbonate, silica, and the like.

Charge generating layer 3 is formed either by vacuum deposition of organic photoconductive material or by coating with a material in which particles of organic photoconductive materials are dispersed in a resin binding material. Charge generating layer 3 receives light and generates charge. For charge generating layer 3, it is important that the charge generating efficiency is high, and at the same, the injectability of the generated charge into charge transport layer 4 is also important. Preferably, there is minimal electric field dependency, and there is good injection even in low electric fields.

For the charge generating material, at least a phthalocyanine compound must be included, but other charge generating materials, for example, pigments or dyes of various azo, quinone, indigo, cyanine, squarilium, azulenium compounds and the like can be used in conjunction.

In the present invention, for every 1 mol of phthalocyanine compound, the content of phthalocyanine dimer compound in charge generating layer 3 is 100 nmol or greater and 300 mmol or less, and preferably 200 nmol or greater and 200 mmol or less. By having this specified amount of phthalocyanine dimer compound in the phthalocyanine compound, the retention rate of electric potential is greatly increased. Although the mechanism for this action is not clear, the following can be considered. In other words, if the phthalocyanine dimer compound content is less than 100 nmol, the phthalocyanine compound is too pure, and there is too much crystal growth, or else, the dispersibility is reduced, and this may cause a decreased retention rate. On the other hand, if the content exceeds 300 mmol, there is too much disruption in the crystal arrangement of the phthalocyanine compound, or else an action of the phthalocyanine dimer compound itself may cause a decreased retention rate. The phthalocyanine dimer contained in the phthalocyanine compound is not limited to having the same center element as the phthalocyanine compound. The same effect can be achieved when a dimer having a different center element is contained.

The synthesis method for the phthalocyanine compound that can be used in the present invention is known. For example, they can be synthesized according to the technique disclosed in Phthalocyanines, C. C. Leznoff, et al., 1989 (VCH Publishers, Inc.), or The Phthalocyanines, F. H. Moser, et al., 1983 (CRC Press), Sens. Actuators B(1998), B48(1~3), 333~338, and the like.

For the phthalocyanine compound that forms the phthalocyanine dimer compound, a titanyl oxo phthalocyanine compound is especially preferred. Furthermore, in the present invention, the center element of this phthalocyanine compound is preferably a transitional metal, and in particular, one selected from the group consisting of: titanium, vanadium, chromium, manganese, iron, cobalt, nickel, zirconium, niobium, molybdenum, rhodium, cerium, neodymium, samarium, europium, and tungsten. Furthermore, a phthalocyanine with a center element that is selected from the group consisting of: indium, gallium, aluminum, germanium, tin, antimony, lead, bismuth, silicon, and phosphorus can also be suitably used. Furthermore, phthalocyanine compounds in which various functional groups are introduced as in the phthalocyanine compound represented by the following formula (1) can also be suitably used.

(1)

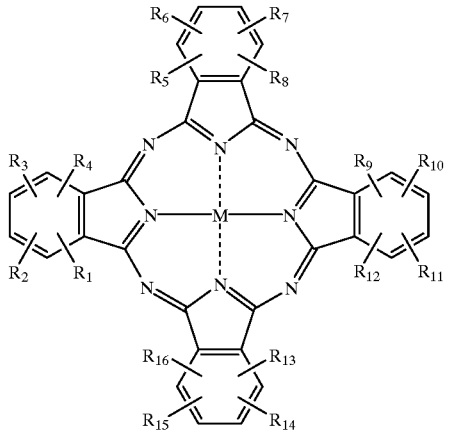

wherein M represents an element from group Ia (in this situation, there may be two atoms), or an element that can have an oxidation state of +2 or greater, or an oxide, a hydroxide, a halide, or an alcohol salt of said element; $R^1$~$R^{16}$ can all be the same or different and represent hydrogen atom, halogen atom, hydroxyl group, nitro group, cyano group, ester group, alkyl group, alkenyl group, alkoxyl group, aryl group, aryloxyl group). Furthermore, in the present invention, as the phthalocyanine compound, the use ofinetal-free phthalocyanines is also preferred.

The dimer compound of the phthalocyanine compound can have various forms. Examples include $\mu$-oxo metal phthalocyanine dimers, $\mu$ metal phthalocyanine dimers, $\mu$ metal phthalocyanine oligomers, and the like. 29H, 31H-phthalocyanine titanyl complexes are also included in this. Preferably, the phthalocyanine dimer compound is a $\mu$ oxo dimer compound, and more preferably, this phthalocyanine dimer compound has a construction of Pc—M—O—M—Pc (Pc is a phthalocyanine compound, M is an element with an oxidation number of +3 or greater, O represents oxygen). Similarly, it is preferable that the phthalocyanine dimer compound is a $\mu$ dimer compound. More preferably, this phthalocyanine dimer compound has a construction of Pc—M—Pc (Pc, M are the same as described previously). An example of a phthalocyanine dimer having this Pc—M—Pc construction includes 29H, 31H-phthalocyanine titanyl complex described above. In addition, an example of another form for the dimer compound of the phthalocyanine compound comprises two phthalocyanine rings joined via at least one carbon atom, nitrogen atom, or oxygen atom, and a titanium atom. For example, 7, 12:13, 58:22, 27;28, 38-tetraimino-15, 20:30, 5-dinitrilo-12, 28:27, 13-bis(nitrilo isoindole [3] iliridene nitrilometheno [1, 2] benzono) tetrabenzo [c, h, n, s][1, 6, 12, 17] tetraazacyclodocosyne, titanium (+1) derivative, 7, 12:13, 58:22, 27;28, 38-tetraimino-15, 20:30, 5-dinitrilo-12, 28:27, 13-bis(nitrilo isoindole [3] iliridene nitrilometheno [1, 2] benzono) tetrabenzo [c, h, n, s][1, 6, 12, 17] tetraazacyclodocosyne, titanyl complex, and the like.

For the detection method for the phthalocyanine compound and the phthalocyanine dimer compound, a matrix assisted laser desorption ionization time of flight mass spectrometry method (henceforth abbreviated as MALDI-TOF-MS method, or simply TOF-MS method), electric field emission mass spectrometry method, fast atom bombardment mass spectrometry method, electron impact ionization mass spectrometry method, and the like can be used.

Phthalocyanine compounds and phthalocyanine dimer compounds have large light absorption coefficients. As a result, when using the MALDI-TOF-MS method, with any of the following sample forms: a very fine powder of particle size less than 400 nm; a fine powder of less than 400 nm dispersed or dissolved alone in organic solvent and then dried by a suitable method; a fine powder of less than 400 nm and various resin binding agents dispersed or dissolved in an organic solvent and then dried by a suitable method, not only can the phthalocyanine compound be detected without adding the matrix compound, but with any of the sample forms, a mass spectrum that reflects the abundance ratio for the phthalocyanine compound can be obtained.

Figure 2:
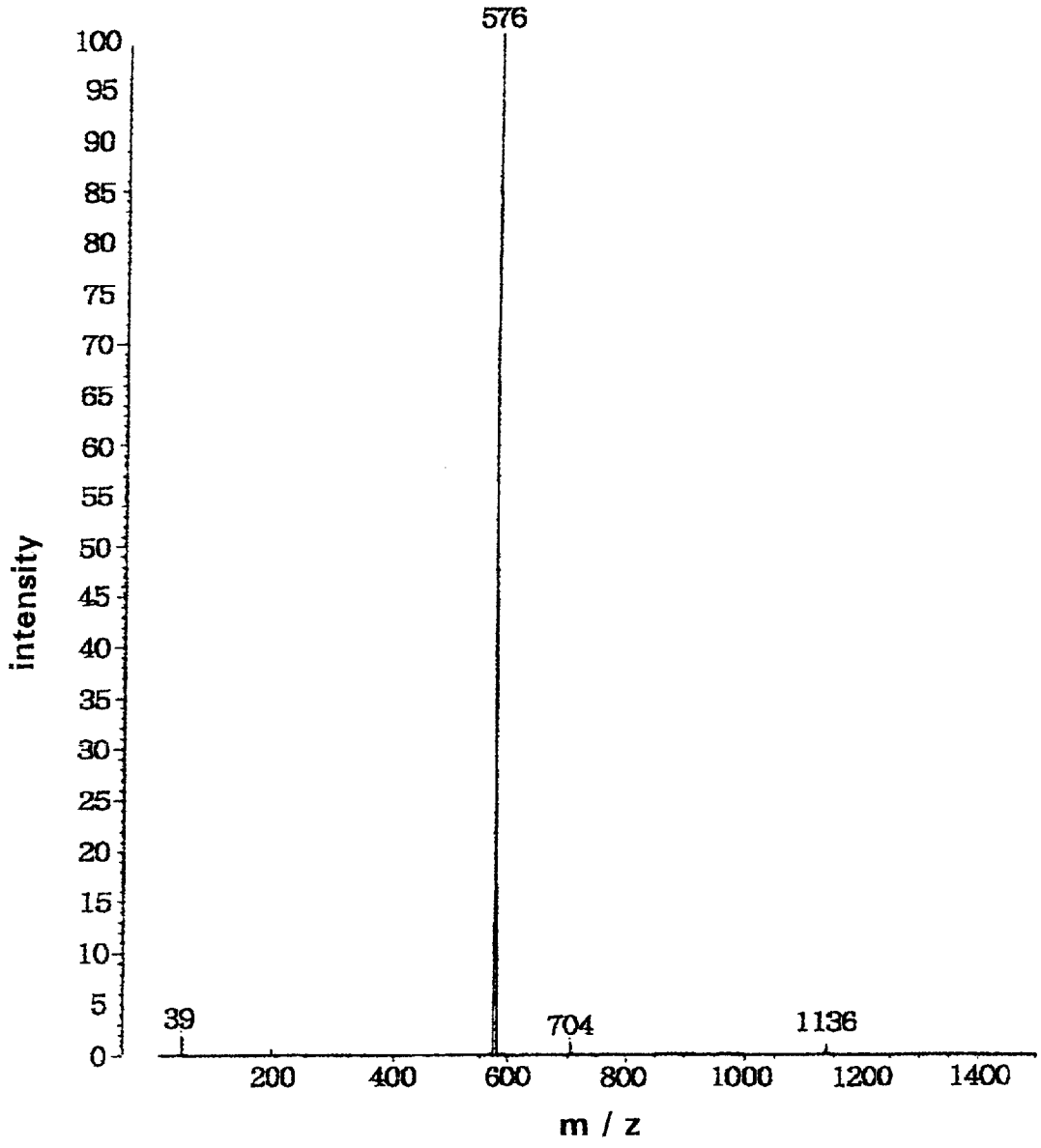
FIG. 2 is a spectral diagram showing one example of a MALDI-TOF-MS spectrum of a titanyl oxo phthalocyanine that contains a mu oxo titanyl phthalocyanine dimer relating to the present invention.

With the situation where the phthalocyanine compound is a titanyl oxo phthalocyanine, when TOF-MS analysis is conducted on the crude synthesis product, not only is there a peak generated for titanyl oxo phthalocyanine ion at a mass number of 576, but there may also be a peak at a mass number of 1136. One example of this spectral diagram is shown in FIG. 2. Referring to the following Table 1, the detection strength of each component is shown. With isotope peaks, only the maximum peaks are shown.

TABLE 1

| Mass number* | Integrated intensity ratio** (%) |
|---|---|
| 39 | 0.49 |
| 192 | 0.21 |
| 576 | 100 |
| 704 | 0.80 |
| 1136 | 0.86 |

*Peaks with an integrated intensity ratio of 0.20% or greater are listed
**Calculated with M = 576 as 100%.

With regard to the peak at mass number of 1136, this is the same mass number as $\mu$ oxo titanyl phthalocyanine dimer. Therefore, when a peak of mass number 1136 is detected, $\mu$ oxo titanyl phthalocyanine dimer compound is clearly present.

With regard to titanyl oxo phthalocyanine that contains μ oxo titanyl phthalocyanine dimer, when measurement was conducted using a MALDI-TOF-MS analytical device (Shimazu Seisakujo (Corp. Ltd) KOMPACT MALDI IV™), by optimizing the laser strength, for every 1 mol of titanyl oxo phthalocyanine, 200 micromol or greater of μ oxo titanyl phthalocyanine dimer could be detected. In addition, it was confirmed that when the abundance ratio of μ oxo titanyl phthalocyanine dimer exceeded 300 mmol for every 1 mol of titanyl oxo phthalocyanine, the integrated intensity of the peak for mass number of 1136 compared to the peak for mass number 576 exceeded 30%.

This component can be removed by sublimation method. Furthermore, in the present invention, phthalocyanine dimer compounds that are generated as by-products during synthesis can be used.

Because the charge generating layer has a charge transport layer layered onto it, its film thickness is determined by the light absorption coefficient of the charge generating material. Generally, the thickness is 5 micrometers or less, and preferably 1 micrometers or less.

Charge generating layer 3 has charge generating material as the main component, and a charge transporting material can be added to this. As the resin binding agent for the charge generating layer, polymers and copolymers of polycarbonate, polyester, polyamide, polyurethane, epoxy, polyvinyl butyral, phenoxy, silicone, ester methacrylate, and their halides and cyanoethylates and the like can be combined and used as appropriate. For every 100 weight parts of resin binding agent, the usage amount of the charge generating material is 10~5000 weight parts, and preferably 50~1000 weight parts.

Charge transport layer 4 is a coated film of a material in which a charge transporting material, for example various hydrazone compounds, styryl compounds, amine compounds, and their derivatives, used singly or combined, are dispersed in a resin binding agent. In dark places, as an insulating layer, charge transport layer 4 retains the charge of the photosensitive body, and during light receiving times, it has a function of transporting the charge injected from the charge generating layer. Polymers, mixture polymers, copolymers and the like of polycarbonate, polyester, polystyrene, ester methacrylate can be used as the resin binding agent for the charge transport layer. For this resin binding agent, mechanical, chemical, and electrical stability, adhesiveness, as well as the compatibility with the charge transporting material are important. For every 100 weight parts of resin binding agent, the usage amount of the charge transporting material is 20~500 weight parts, and preferably 30~300 weight parts. In order to have an effective maintenance of surface electric potential in practice, the film thickness of the charge transport layer is preferably in the range of 3~50 micrometers, and more preferably in the range of 15~40 micrometers.

Embodiments

Concrete embodiments of the present invention are described below, but the present invention is not limited to these embodiments.

Embodiment 1

Formation of Undercoat Layer 70 weight parts of a polyamide resin (AM ILAN CM8000™ by Toray Corp. Ltd.) and 930 weight parts of methanol (Wako Junyaku Kogyo Corp. Ltd.) were mixed, and a coating solution for the undercoat layer was created. This undercoat layer coating solution was coated on top of an aluminum substrate by a dip coating method. After drying, an undercoat layer with a film thickness of 0.5 micrometers was formed.

Formation of Charge Generating Layer

1. Into a reaction container, 800 g of o-phthalodinitrile (Tokyo Kasei Kogyo Corp. Ltd.) and 1.8 liters of quinoline (Kanto Kagaku Corp. Ltd.) were added and agitated. Under a nitrogen atmosphere, 297 g of titanium tetrachloride (Kishida Kagaku Corp. Ltd) was dripped and agitated. After dripping, this was heated for 15 hours at 180 degrees C, and this was further agitated.

2. This reaction solution was allowed to cool to 130 degrees C, and this was then filtered and rinsed in 3 liters of N-methyl-2-pyrrolidinone (Kanto Kagaku Corp. Ltd.). Under a nitrogen atmosphere, this wet cake was heated and agitated for 1 hour at 160 degrees C in 1.8 liters of N-methyl-2-pyrrolidinone. This was allowed to cool and was filtered. This was sequentially rinsed in 3 liters of N-methyl-2-pyrrolidinone, 2 liters of acetone (Kanto Kagaku Corp. Ltd.), 2 liters of methanol (Kanto Kagaku Corp. Ltd.) and 4 liters of warm water.

3. The titanyl oxo phthalocyanine wet cake obtained in this manner was further heated and agitated for 1 hour at 80 degrees C in 4 liters of water and 360 ml of a dilute hydrochloric acid of 36% hydrochloric acid (Kanto Kagaku Corp. Ltd.). This was allowed to cool and was filtered. After rinsing with 4 liters of warm water, this was dried. This was purified three times by a vacuum sublimation method and then dried.

4. Next, while agitating and cooling so that the liquid temperature did not exceed −5 degrees C, 200 g of the above dried product was added to 4 kg of 96% sulfuric acid (Kanto Kagaku Corp. Ltd.) at −5 degrees C. Maintaining at −5 degrees C, this was cooled and agitated for 1 hour. In addition, while agitating and cooling so that the liquid temperature did not exceed 10 degrees C, this sulfuric acid solution was added to 35 liters of water, 5 kgs of ice. This was cooled and agitated for 1 hour. This was filtered and rinsed with 10 liters of warm water.

5. This was further heated and agitated for 1 hour at 80 degrees in 10 liters of water and 770 ml of dilute hydrochloric acid of 36% hydrochloric acid. Next, this was allowed to cool and was filtered. After rinsing with 10 liters of warm water, this was dried, and titanyl oxo phthalocyanine was obtained.

6. The μ oxo titanyl phthalocyanine dimer that was synthesized according to the previous reference of Phthalocyanines, C. C. Leznoff et al, 1989 (VCH Publishers, Inc.) was added to the above titanyl oxo phthalocyanine at 100 nmol for every 1 mol of titanyl oxo phthalocyanine. This and 0.5 liters of water and 1.5 liters of o-dichlorobenzene (Kanto Kagaku Corp. Ltd.) were placed inside a ball mill device inside which there is a 6.6 kg zirconia ball of a diameter 8 mm. This was milled for 24 hours. Next, this was removed with 1.5 liters acetone, 1.5 liters methanol. This was filtered and rinsed with 1.5 liters of water and then dried.

7. 10 weight parts of this titanyl oxo phthalocyanine that contains μ oxo titanyl phthalocyanine dimer and 10 weight parts of vinyl chloride resin (MR-110™ by Nihon Zeon Corp. Ltd.) and 686 weight parts of dichloromethane and 294 weight parts of 1,2-dichloroethane were mixed, and ultrasonic dispersion was conducted, and a coating solution for the charge generating layer was created. This charge generating layer coating solution was coated by a dip coating method on top of the undercoat layer described previously. After drying, a charge generating layer with a film thickness of 0.2 micrometers was formed.

Formation of the Charge Transport Layer 100 weight parts of 4-(diphenyl amino) benzaldehyde phenyl (2-thienyl methyl) hydrazone (Fuji Denki Corp.

Ltd.), 100 weight parts of polycarbonate resin (PAN LITE K-1300™ manufactured by Teijin Kasei Corp. Ltd.), 800 weight parts of dichloromethane, 1 weight part of silane coupling agent (KP-340™ manufactured by Shinetsu Kagaku Kogyo), and 4 weight parts of bis (2,4-di-tert-butylphenyl) phenyl phosphonite (Fuji Denki Corp. Ltd.) were mixed, and a charge transport layer coating solution was created. This charge transport layer coating solution was coated by a dip coating method on top of the charge generating layer described above. After drying, a charge transport layer with a film thickness of 20 micrometers was formed, and the electrophotography photosensitive body was manufactured.

Embodiment 2

A photosensitive body was manufactured in the same manner as Embodiment 1, except that the amount of $\mu$ oxo titanyl phthalocyanine dimer of Embodiment 1 was changed to 10 micromols for every 1 mol of titanyl oxo phthalocyanine.

Embodiment 3

A photosensitive body was manufactured in the same manner as Embodiment 1, except that the amount of $\mu$ oxo titanyl phthalocyanine dimer of Embodiment 1 was changed to 1 mmol for every 1 mol of titanyl oxo phthalocyanine.

Embodiment 4

A photosensitive body was manufactured in the same manner as Embodiment 1, except that the amount of $\mu$ oxo titanyl phthalocyanine dimer of Embodiment 1 was changed to 100 mmol for every 1 mol of titanyl oxo phthalocyanine.

Embodiment 5

A photosensitive body was manufactured in the same manner as Embodiment 1, except that the amount of $\mu$ oxo titanyl phthalocyanine dimer of Embodiment 1 was changed to 300 mmol for every 1 mol of titanyl oxo phthalocyanine.

Embodiment 6

A photosensitive body was manufactured in the same manner as Embodiment 1, except that after adding the $\mu$ oxo titanyl phthalocyanine dimer of Embodiment 1, this was treated by acid pasting with 96% sulfuric acid, and after rinsing with water, this was dried.

Embodiment 7

A photosensitive body was manufactured in the same manner as Embodiment 6, except that the amount of $\mu$ oxo titanyl phthalocyanine dimer of Embodiment 6 was changed to 10 micromols for every 1 mol of titanyl oxo phthalocyanine.

Embodiment 8

A photosensitive body was manufactured in the same manner as Embodiment 6, except that the amount of $\mu$ oxo titanyl phthalocyanine dimer of Embodiment 6 was changed to 1 mmol for every 1 mol of titanyl oxo phthalocyanine.

Embodiment 9

A photosensitive body was manufactured in the same manner as Embodiment 6, except that the amount of $\mu$ oxo titanyl phthalocyanine dimer of Embodiment 6 was changed to 100 mmol for every 1 mol of titanyl oxo phthalocyanine.

Embodiment 10

A photosensitive body was manufactured in the same manner as Embodiment 6, except that the amount of $\mu$ oxo titanyl phthalocyanine dimer of Embodiment 6 was changed to 300 mmol for every 1 mol of titanyl oxo phthalocyanine.

COMPARATIVE EXAMPLE 1

A photosensitive body was manufactured in the same manner as Embodiment 1, except that the amount of $\mu$ oxo titanyl phthalocyanine dimer of Embodiment 1 was changed to 50 mmol for every 1 mol of titanyl oxo phthalocyanine.

COMPARATIVE EXAMPLE 2

A photosensitive body was manufactured in the same manner as Embodiment 1, except that the amount of $\mu$ oxo titanyl phthalocyanine dimer of Embodiment 1 was changed to 400 mmol for every 1 mol of titanyl oxo phthalocyanine.

COMPARATIVE EXAMPLE 3

A photosensitive body was manufactured in the same manner as Embodiment 6, except that the amount of $\mu$ oxo titanyl phthalocyanine dimer of Embodiment 6 was changed to 50 mmol for every 1 mol of titanyl oxo phthalocyanine.

COMPARATIVE EXAMPLE 4

A photosensitive body was manufactured in the same manner as Embodiment 6, except that the amount of $\mu$ oxo titanyl phthalocyanine dimer of Embodiment 6 was changed to 400 mmol for every 1 mol of titanyl oxo phthalocyanine.

The electrical properties of the photosensitive bodies obtained in this manner were measured using an electrostatic recording paper test device (EPA-8200™ manufactured by Kawaguchi Denki Seisakujo). The photosensitive body was charged to a surface electric potential of −600V by a corotron in the dark. This was left in the dark for 5 seconds, and the retention rate (%) of electric potential during that time was measured. The obtained results are shown in Table 2 below.

TABLE 2

| | Retention rate (%) | | Retention rate (%) |
|---|---|---|---|
| Embodiment 1 | 98.0 | Comparative example 1 | 91.3 |
| Embodiment 2 | 97.3 | Comparative example 2 | 89.2 |
| Embodiment 3 | 97.4 | Comparative example 3 | 91.8 |
| Embodiment 4 | 97.3 | Comparative example 4 | 89.0 |
| Embodiment 5 | 97.5 | | |
| Embodiment 6 | 97.0 | | |
| Embodiment 7 | 98.3 | | |
| Embodiment 8 | 97.2 | | |
| Embodiment 9 | 97.6 | | |
| Embodiment 10 | 97.8 | | |

As is clear from Table 2, all of the embodiments were good with high retention rates, but all of the comparative examples had lower retention rates compared to all of the embodiments.

Furthermore, with the titanyl oxo phthalocyanine that contains $\mu$ oxo titanyl phthalocyanine dimer used in Embodiments 3~5 and Embodiments 8~10, when measurement was conducted using a MALDI-TOF MS analytical device (KOMPACT MALDI IV™ manufactured by Shimazu Seisakujo Corp. Ltd.), all of them showed clear peaks at mass number 576 and mass number 1136. The mass number 576 could be identified as titanyl oxo phthalocyanine molecular ion. The integrated intensity ratio of the peak for mass number 1136 was greater than $10^{-5}$% of the peak for mass number 576.

Furthermore, with the electrophotography photosensitive bodies created in Embodiments 3~5 and Embodiments 8~10, extraction and removal treatment of the charge generating material, oxidation inhibiting agents, silane coupling material were conducted using an acetone ultrasonic bath. After dissolving and removing the charge transport layer resin by dichloromethane immersion, a solution, in which charge generating material and charge generating material resin were dispersed, was prepared by dichloromethane immersion in an ultrasonic bath. When measurement was conducted using the TOF-MS analytical device, all of them showed clear peaks at mass number 576 and mass number 1136. The mass number 576 could be identified as titanyl oxo phthalocyanine molecular ion. The integrated intensity ratio of the peak for mass number 1136 was greater than $10^{-5}$% of the peak for mass number 576.

Embodiment 11

A photosensitive body was manufactured in the same manner as Embodiment 1, except that the $\mu$ oxo titanyl phthalocyanine dimer of Embodiment 1 was changed to a $\mu$ oxo manganese phthalocyanine dimer synthesized according to a standard method.

Embodiment 12

A photosensitive body was manufactured in the same manner as Embodiment 11, except that the amount of $\mu$ oxo manganese phthalocyanine dimer of Embodiment 11 was changed to 10 micromol for every 1 mol of titanyl oxo phthalocyanine.

Embodiment 13

A photosensitive body was manufactured in the same manner as Embodiment 11, except that the amount of $\mu$ oxo manganese phthalocyanine dimer of Embodiment 11 was changed to 1 mmol for every 1 mol of titanyl oxo phthalocyanine.

Embodiment 14

A photosensitive body was manufactured in the same manner as Embodiment 11, except that the amount of $\mu$ oxo manganese phthalocyanine dimer of Embodiment 11 was changed to 100 mmol for every 1 mol of titanyl oxo phthalocyanine.

Embodiment 15

A photosensitive body was manufactured in the same manner as Embodiment 11, except that the amount of $\mu$ oxo manganese phthalocyanine dimer of Embodiment 11 was changed to 300 mmol for every 1 mol of titanyl oxo phthalocyanine.

Embodiment 16

A photosensitive body was manufactured in the same manner as Embodiment 11, except that after adding the $\mu$ oxo manganese phthalocyanine dimer of Embodiment 11, this was treated by acid pasting with 96% sulfuric acid, and after rinsing with water, this was dried.

Embodiment 17

A photosensitive body was manufactured in the same manner as Embodiment 16, except that the amount of $\mu$ oxo manganese phthalocyanine dimer of Embodiment 16 was changed to 10 micromol for every 1 mol of titanyl oxo phthalocyanine.

Embodiment 18

A photosensitive body was manufactured in the same manner as Embodiment 16, except that the amount of $\mu$ oxo manganese phthalocyanine dimer of Embodiment 16 was changed to 1 mmol for every 1 mol of titanyl oxo phthalocyanine.

Embodiment 19

A photosensitive body was manufactured in the same manner as Embodiment 16, except that the amount of $\mu$ oxo manganese phthalocyanine dimer of Embodiment 16 was changed to 100 mmol for every 1 mol of titanyl oxo phthalocyanine.

Embodiment 20

A photosensitive body was manufactured in the same manner as Embodiment 16, except that the amount of $\mu$ oxo manganese phthalocyanine dimer of Embodiment 16 was changed to 300 mmol for every 1 mol of titanyl oxo phthalocyanine.

COMPARATIVE EXAMPLE 5

A photosensitive body was manufactured in the same manner as Embodiment 11, except that the amount of $\mu$ oxo manganese phthalocyanine dimer of Embodiment 11 was changed to 50 mmol for every 1 mol of titanyl oxo phthalocyanine.

COMPARATIVE EXAMPLE 6

A photosensitive body was manufactured in the same manner as Embodiment 11, except that the amount of $\mu$ oxo manganese phthalocyanine dimer of Embodiment 11 was changed to 400 mmol for every 1 mol of titanyl oxo phthalocyanine.

COMPARATIVE EXAMPLE 7

A photosensitive body was manufactured in the same manner as Embodiment 16, except that the amount of $\mu$ oxo manganese phthalocyanine dimer of Embodiment 16 was changed to 50 mmol for every 1 mol of titanyl oxo phthalocyanine.

COMPARATIVE EXAMPLE 8

A photosensitive body was manufactured in the same manner as Embodiment 16, except that the amount of $\mu$ oxo manganese phthalocyanine dimer of Embodiment 16 was changed to 400 mmol for every 1 mol of titanyl oxo phthalocyanine.

The electrical properties of the photosensitive bodies obtained in this manner were measured in the same manner as described above, and the retention rates (%) were obtained. The obtained results are shown in the following Table 3.

TABLE 3

| | Retention rate (%) | | Retention rate (%) |
|---|---|---|---|
| Embodiment 11 | 98.2 | Comparative example 5 | 91.8 |
| Embodiment 12 | 97.1 | Comparative example 6 | 89.1 |
| Embodiment 13 | 97.8 | Comparative example 7 | 91.2 |
| Embodiment 14 | 97.2 | Comparative example 8 | 88.7 |
| Embodiment 15 | 97.6 | | |
| Embodiment 16 | 97.3 | | |
| Embodiment 17 | 98.1 | | |
| Embodiment 18 | 97.7 | | |
| Embodiment 19 | 97.4 | | |
| Embodiment 20 | 97.9 | | |

As is clear from Table 3, all of the embodiments were good with high retention rates, but all of the comparative examples had lower retention rates compared to all of the embodiments.

Embodiment 21

A photosensitive body was manufactured in the same manner as Embodiment 1, except that the titanyl oxo phthalocyanine of Embodiment 1 was changed to an iron phthalocyanine synthesized according to a standard method.

Embodiment 22

A photosensitive body was manufactured in the same manner as Embodiment 21, except that the amount of $\mu$ oxo titanyl phthalocyanine dimer of Embodiment 21 was changed to 10 micromol for every 1 mol of iron phthalocyanine.

Embodiment 23

A photosensitive body was manufactured in the same manner as Embodiment 21, except that the amount of $\mu$ oxo titanyl phthalocyanine dimer of Embodiment 21 was changed to 1 mmol for every 1 mol of iron phthalocyanine.

Embodiment 24

A photosensitive body was manufactured in the same manner as Embodiment 21, except that the amount of $\mu$ oxo titanyl phthalocyanine dimer of Embodiment 21 was changed to 100 mmol for every 1 mol of iron phthalocyanine.

Embodiment 25

A photosensitive body was manufactured in the same manner as Embodiment 21, except that the amount of $\mu$ oxo titanyl phthalocyanine dimer of Embodiment 21 was changed to 300 mmol for every 1 mol of iron phthalocyanine.

Embodiment 26

A photosensitive body was manufactured in the same manner as Embodiment 21, except that after adding the $\mu$ oxo titanyl phthalocyanine dimer of Embodiment 21, this was treated by acid pasting with 96% sulfuric acid, and after rinsing with water, this was dried.

Embodiment 27

A photosensitive body was manufactured in the same manner as Embodiment 26, except that the amount of $\mu$ oxo titanyl phthalocyanine dimer of Embodiment 26 was changed to 10 micromol for every 1 mol of iron phthalocyanine.

Embodiment 28

A photosensitive body was manufactured in the same manner as Embodiment 26, except that the amount of $\mu$ oxo titanyl phthalocyanine dimer of Embodiment 26 was changed to 1 mmol for every 1 mol of iron phthalocyanine.

Embodiment 29

A photosensitive body was manufactured in the same manner as Embodiment 26, except that the amount of $\mu$ oxo titanyl phthalocyanine dimer of Embodiment 26 was changed to 100 mmol for every 1 mol of iron phthalocyanine.

Embodiment 30

A photosensitive body was manufactured in the same manner as Embodiment 26, except that the amount of $\mu$ oxo titanyl phthalocyanine dimer of Embodiment 26 was changed to 300 mmol for every 1 mol of iron phthalocyanine.

COMPARATIVE EXAMPLE 9

A photosensitive body was manufactured in the same manner as Embodiment 21, except that the amount of $\mu$ oxo titanyl phthalocyanine dimer of Embodiment 21 was changed to 50 mmol for every 1 mol of iron phthalocyanine.

COMPARATIVE EXAMPLE 10

A photosensitive body was manufactured in the same manner as Embodiment 21, except that the amount of $\mu$ oxo titanyl phthalocyanine dimer of Embodiment 21 was changed to 400 mmol for every 1 mol of iron phthalocyanine.

COMPARATIVE EXAMPLE 11

A photosensitive body was manufactured in the same manner as Embodiment 26, except that the amount of $\mu$ oxo titanyl phthalocyanine dimer of Embodiment 26 was changed to 50 mmol for every 1 mol of iron phthalocyanine.

COMPARATIVE EXAMPLE 12

A photosensitive body was manufactured in the same manner as Embodiment 26, except that the amount of $\mu$ oxo titanyl phthalocyanine dimer of Embodiment 26 was changed to 400 mmol for every 1 mol of iron phthalocyanine.

The electrical properties of the photosensitive bodies obtained in this manner were measured in the same manner as described above, and the retention rates (%) were obtained. The obtained results are shown in the following Table 4.

TABLE 4

| | Retention rate (%) | | Retention rate (%) |
|---|---|---|---|
| Embodiment 21 | 95.6 | Comparative example 9 | 89.2 |
| Embodiment 22 | 96.1 | Comparative example 10 | 87.9 |
| Embodiment 23 | 95.7 | Comparative example 11 | 88.2 |
| Embodiment 24 | 95.4 | Comparative example 12 | 87.4 |
| Embodiment 25 | 95.0 | | |
| Embodiment 26 | 95.3 | | |
| Embodiment 27 | 94.6 | | |
| Embodiment 28 | 95.2 | | |
| Embodiment 29 | 95.6 | | |
| Embodiment 30 | 95.1 | | |

As is clear from Table 4, all of the embodiments were good with high retention rates, but all of the comparative examples had lower retention rates compared to the embodiments.

Embodiment 31

A photosensitive body was manufactured in the same manner as Embodiment 21, except that the $\mu$ oxo titanyl phthalocyanine dimer of Embodiment 21 was changed to a $\mu$ oxo iron phthalocyanine dimer synthesized according to a standard method.

Embodiment 32

A photosensitive body was manufactured in the same manner as Embodiment 31, except that the amount of $\mu$ oxo iron phthalocyanine dimer of Embodiment 31 was changed to 10 micromol for every 1 mol of iron phthalocyanine.

Embodiment 33

A photosensitive body was manufactured in the same manner as Embodiment 31 except that the amount of $\mu$ oxo iron phthalocyanine dimer of Embodiment 31 was changed to 1 mmol for every 1 mol of iron phthalocyanine.

Embodiment 34

A photosensitive body was manufactured in the same manner as Embodiment 31, except that the amount of $\mu$ oxo iron phthalocyanine dimer of Embodiment 31 was changed to 100 mmol for every 1 mol of iron phthalocyanine.

Embodiment 35

A photosensitive body was manufactured in the same manner as Embodiment 31, except that the amount of $\mu$ oxo iron phthalocyanine dimer of Embodiment 31 was changed to 300 mmol for every 1 mol of iron phthalocyanine.

Embodiment 36

A photosensitive body was manufactured in the same manner as Embodiment 31, except that after adding the $\mu$ oxo iron phthalocyanine dimer of Embodiment 31, this was treated by acid pasting with 96% sulfuric acid, and after rinsing with water, this was dried.

Embodiment 37

A photosensitive body was manufactured in the same manner as Embodiment 36, except that the amount of $\mu$ oxo iron phthalocyanine dimer of Embodiment 36 was changed to 10 micromol for every 1 mol of iron phthalocyanine.

Embodiment 38

A photosensitive body was manufactured in the same manner as Embodiment 36, except that the amount of $\mu$ oxo iron phthalocyanine dimer of Embodiment 36 was changed to 1 mmol for every 1 mol of iron phthalocyanine.

Embodiment 39

A photosensitive body was manufactured in the same manner as Embodiment 36, except that the amount of $\mu$ oxo iron phthalocyanine dimer of Embodiment 36 was changed to 100 mmol for every 1 mol of iron phthalocyanine.

Embodiment 40

A photosensitive body was manufactured in the same manner as Embodiment 36, except that the amount of $\mu$ oxo iron phthalocyanine dimer of Embodiment 36 was changed to 300 mmol for every 1 mol of iron phthalocyanine.

COMPARATIVE EXAMPLE 13

A photosensitive body was manufactured in the same manner as Embodiment 31, except that the amount of $\mu$ oxo iron phthalocyanine dimer of Embodiment 31 was changed to 50 mmol for every 1 mol of iron phthalocyanine.

COMPARATIVE EXAMPLE 14

A photosensitive body was manufactured in the same manner as Embodiment 31, except that the amount of $\mu$ oxo iron phthalocyanine dimer of Embodiment 31 was changed to 400 mmol for every 1 mol of iron phthalocyanine.

COMPARATIVE EXAMPLE 15

A photosensitive body was manufactured in the same manner as Embodiment 36, except that the amount of $\mu$ oxo iron phthalocyanine dimer of Embodiment 36 was changed to 50 mmol for every 1 mol of iron phthalocyanine.

COMPARATIVE EXAMPLE 16

A photosensitive body was manufactured in the same manner as Embodiment 36, except that the amount of $\mu$ oxo iron phthalocyanine dimer of Embodiment 36 was changed to 400 mmol for every 1 mol of iron phthalocyanine.

The electrical properties of the photosensitive bodies obtained in this manner were measured in the same manner as described above, and the retention rates (%) were obtained. The obtained results are shown in the following Table 5.

TABLE 5

| | Retention rate (%) | | Retention rate (%) |
|---|---|---|---|
| Embodiment 31 | 95.3 | Comparative example 13 | 88.2 |
| Embodiment 32 | 95.2 | Comparative example 14 | 87.1 |
| Embodiment 33 | 95.8 | Comparative example 15 | 88.4 |
| Embodiment 34 | 95.2 | Comparative example 16 | 87.7 |
| Embodiment 35 | 94.9 | | |
| Embodiment 36 | 95.3 | | |
| Embodiment 37 | 95.1 | | |
| Embodiment 38 | 94.7 | | |
| Embodiment 39 | 95.3 | | |
| Embodiment 40 | 95.4 | | |

As is clear from Table 5, all of the embodiments were good with high retention rates, but all of the comparative examples had lower retention rates compared to the embodiments.

Embodiment 41

A photosensitive body was manufactured in the same manner as Embodiment 31, except that the iron phthalocyanine of Embodiment 31 was changed to an iron (11) 1, 2, 3, 4, 8, 9, 10, 11, 15, 16, 17, 18, 22, 23, 24, 25-hexadecafluoro-29H, 31H-phthalocyanine (henceforth abbreviated as fluoro iron phthalocyanine) synthesized according to a standard method.

Embodiment 42

A photosensitive body was manufactured in the same manner as Embodiment 41, except that the amount of $\mu$ oxo iron phthalocyanine dimer of Embodiment 41 was changed to 10 micromol for every 1 mol of fluoro iron phthalocyanine.

Embodiment 43

A photosensitive body was manufactured in the same manner as Embodiment 41, except that the amount of $\mu$ oxo iron phthalocyanine dimer of Embodiment 41 was changed to 1 mmol for every 1 mol of fluoro iron phthalocyanine.

Embodiment 44

A photosensitive body was manufactured in the same manner as Embodiment 41, except that the amount of $\mu$ oxo iron phthalocyanine dimer of Embodiment 41 was changed to 100 mmol for every 1 mol of fluoro iron phthalocyanine.

Embodiment 45

A photosensitive body was manufactured in the same manner as Embodiment 41 except that the amount of $\mu$ oxo iron phthalocyanine dimer of Embodiment 41 was changed to 300 mmol for every 1 mol of fluoro iron phthalocyanine.

Embodiment 46

A photosensitive body was manufactured in the same manner as Embodiment 41, except that after adding the $\mu$ oxo iron phthalocyanine dimer of Embodiment 41, this was treated by acid pasting with 96% sulfuric acid, and after rinsing with water, this was dried.

Embodiment 47

A photosensitive body was manufactured in the same manner as Embodiment 46, except that the amount of $\mu$ oxo iron phthalocyanine dimer of Embodiment 46 was changed to 10 micromol for every 1 mol of fluoro iron phthalocyanine.

Embodiment 48

A photosensitive body was manufactured in the same manner as Embodiment 46, except that the amount of $\mu$ oxo iron phthalocyanine dimer of Embodiment 46 was changed to 1 mmol for every 1 mol of fluoro iron phthalocyanine.

Embodiment 49

A photosensitive body was manufactured in the same manner as Embodiment 46, except that the amount of $\mu$ oxo iron phthalocyanine dimer of Embodiment 46 was changed to 100 mmol for every 1 mol of fluoro iron phthalocyanine.

Embodiment 50

A photosensitive body was manufactured in the same manner as Embodiment 46, except that the amount of $\mu$ oxo iron phthalocyanine dimer of Embodiment 46 was changed to 300 mmol for every 1 mol of fluoro iron phthalocyanine.

COMPARATIVE EXAMPLE 17

A photosensitive body was manufactured in the same manner as Embodiment 41, except that the amount of $\mu$ oxo iron phthalocyanine dimer of Embodiment 41 was changed to 50 mmol for every 1 mol of fluoro iron phthalocyanine.

COMPARATIVE EXAMPLE 18

A photosensitive body was manufactured in the same manner as Embodiment 41, except that the amount of $\mu$ oxo iron phthalocyanine dimer of Embodiment 41 was changed to 400 mmol for every 1 mol of fluoro iron phthalocyanine.

COMPARATIVE EXAMPLE 19

A photosensitive body was manufactured in the same manner as Embodiment 46, except that the amount of $\mu$ oxo iron phthalocyanine dimer of Embodiment 46 was changed to 50 mmol for every 1 mol of fluoro iron phthalocyanine.

COMPARATIVE EXAMPLE 20

A photosensitive body was manufactured in the same manner as Embodiment 46, except that the amount of $\mu$ oxo iron phthalocyanine dimer of Embodiment 46 was changed to 400 mmol for every 1 mol of fluoro iron phthalocyanine.

The electrical properties of the photosensitive bodies obtained in this manner were measured in the same manner as described above, and the retention rates (%) were obtained. The obtained results are shown in the following Table 6.

TABLE 6

| | Retention rate (%) | | Retention rate (%) |
|---|---|---|---|
| Embodiment 41 | 96.1 | Comparative example 17 | 89.4 |
| Embodiment 42 | 95.4 | Comparative example 18 | 88.0 |
| Embodiment 43 | 95.8 | Comparative example 19 | 89.2 |
| Embodiment 44 | 96.0 | Comparative example 20 | 88.3 |
| Embodiment 45 | 95.4 | | |
| Embodiment 46 | 95.5 | | |
| Embodiment 47 | 95.5 | | |
| Embodiment 48 | 95.2 | | |
| Embodiment 49 | 95.3 | | |
| Embodiment 50 | 95.9 | | |

As is clear from Table 6, all of the embodiments were good with high retention rates, but all of the comparative examples had lower retention rates compared to the embodiments.

Embodiment 51

A photosensitive body was manufactured in the same manner as Embodiment 21, except that the iron phthalocyanine of Embodiment 21 was changed to a zirconium phthalocyanine synthesized according to a standard method.

Embodiment 52

A photosensitive body was manufactured in the same manner as Embodiment 51, except that the amount of $\mu$ oxo titanyl phthalocyanine dimer of Embodiment 51 was changed to 10 micromol for every 1 mol of zirconium phthalocyanine.

Embodiment 53

A photosensitive body was manufactured in the same manner as Embodiment 51, except that the amount of $\mu$ oxo titanyl phthalocyanine dimer of Embodiment 51 was changed to 1 mmol for every 1 mol of zirconium phthalocyanine.

Embodiment 54

A photosensitive body was manufactured in the same manner as Embodiment 51, except that the amount of $\mu$ oxo titanyl phthalocyanine dimer of Embodiment 51 was changed to 100 mmol for every 1 mol of zirconium phthalocyanine.

Embodiment 55

A photosensitive body was manufactured in the same manner as Embodiment 51, except that the amount of $\mu$ oxo titanyl phthalocyanine dimer of Embodiment 51 was changed to 300 mmol for every 1 mol of zirconium phthalocyanine.

Embodiment 56

A photosensitive body was manufactured in the same manner as Embodiment 51, except that after adding the $\mu$ oxo titanyl phthalocyanine dimer of Embodiment 51, this was treated by acid pasting with 96% sulfuric acid, and after rinsing with water, this was dried.

Embodiment 57

A photosensitive body was manufactured in the same manner as Embodiment 56, except that the amount of $\mu$ oxo titanyl phthalocyanine dimer of Embodiment 56 was changed to 10 micromol for every 1 mol of zirconium phthalocyanine.

Embodiment 58

A photosensitive body was manufactured in the same manner as Embodiment 56, except that the amount of $\mu$ oxo titanyl phthalocyanine dimer of Embodiment 56 was changed to 1 mmol for every 1 mol of zirconium phthalocyanine.

Embodiment 59

A photosensitive body was manufactured in the same manner as Embodiment 56, except that the amount of $\mu$ oxo titanyl phthalocyanine dimer of Embodiment 56 was changed to 100 mmol for every 1 mol of zirconium phthalocyanine.

Embodiment 60

A photosensitive body was manufactured in the same manner as Embodiment 56, except that the amount of $\mu$ oxo titanyl phthalocyanine dimer of Embodiment 56 was changed to 300 mmol for every 1 mol of zirconium phthalocyanine.

COMPARATIVE EXAMPLE 21

A photosensitive body was manufactured in the same manner as Embodiment 51, except that the amount of $\mu$ oxo titanyl phthalocyanine dimer of Embodiment 51 was changed to 50 nmol for every 1 mol of zirconium phthalocyanine.

COMPARATIVE EXAMPLE 22

A photosensitive body was manufactured in the same manner as Embodiment 51, except that the amount of $\mu$ oxo titanyl phthalocyanine dimer of Embodiment 51 was changed to 400 mmol for every 1 mol of zirconium phthalocyanine.

COMPARATIVE EXAMPLE 23

A photosensitive body was manufactured in the same manner as Embodiment 56, except that the amount of $\mu$ oxo titanyl phthalocyanine dimer of Embodiment 56 was changed to 50 nmol for every 1 mol of zirconium phthalocyanine.

COMPARATIVE EXAMPLE 24

A photosensitive body was manufactured in the same manner as Embodiment 56, except that the amount of $\mu$ oxo titanyl phthalocyanine dimer of Embodiment 56 was changed to 400 mmol for every 1 mol of zirconium phthalocyanine.

The electrical properties of the photosensitive bodies obtained in this manner were measured in the same manner as described above, and the retention rates (%) were obtained. The obtained results are shown in the following Table 7.

TABLE 7

| | Retention rate (%) | | Retention rate (%) |
|---|---|---|---|
| Embodiment 51 | 95.3 | Comparative example 21 | 88.9 |
| Embodiment 52 | 95.7 | Comparative example 22 | 88.1 |

TABLE 7-continued

| | Retention rate (%) | | Retention rate (%) |
|---|---|---|---|
| Embodiment 53 | 95.8 | Comparative example 23 | 88.2 |
| Embodiment 54 | 95.0 | Comparative example 24 | 87.7 |
| Embodiment 55 | 95.6 | | |
| Embodiment 56 | 95.0 | | |
| Embodiment 57 | 95.5 | | |
| Embodiment 58 | 95.1 | | |
| Embodiment 59 | 95.4 | | |
| Embodiment 60 | 95.6 | | |

As is clear from Table 7, all of the embodiments were good with high retention rates, but all of the comparative examples had lower retention rates compared to the embodiments.

Embodiment 61

A photosensitive body was manufactured in the same manner as Embodiment 31, except that the iron phthalocyanine of Embodiment 31 was changed to a vanadium phthalocyanine synthesized according to a standard method.

Embodiment 62

A photosensitive body was manufactured in the same manner as Embodiment 61, except that the amount of $\mu$ oxo iron phthalocyanine dimer of Embodiment 61 was changed to 10 micromol for every 1 mol of vanadium phthalocyanine.

Embodiment 63

A photosensitive body was manufactured in the same manner as Embodiment 61 except that the amount of $\mu$ oxo iron phthalocyanine dimer of Embodiment 61 was changed to 1 mmol for every 1 mol of vanadium phthalocyanine.

Embodiment 64

A photosensitive body was manufactured in the same manner as Embodiment 61 except that the amount of $\mu$ oxo iron phthalocyanine dimer of Embodiment 61 was changed to 100 mmol for every 1 mol of vanadium phthalocyanine.

Embodiment 65

A photosensitive body was manufactured in the same manner as Embodiment 61, except that the amount of $\mu$ oxo iron phthalocyanine dimer of Embodiment 61 was changed to 300 mmol for every 1 mol of vanadium phthalocyanine.

Embodiment 66

A photosensitive body was manufactured in the same manner as Embodiment 61, except that after adding the $\mu$ oxo iron phthalocyanine dimer of Embodiment 61, this was treated by acid pasting with 96% sulfuric acid, and after rinsing with water, this was dried.

Embodiment 67

A photosensitive body was manufactured in the same manner as Embodiment 66, except that the amount of $\mu$ oxo iron phthalocyanine dimer of Embodiment 66 was changed to 10 micromol for every 1 mol of vanadium phthalocyanine.

Embodiment 68

A photosensitive body was manufactured in the same manner as Embodiment 66, except that the amount of $\mu$ oxo iron phthalocyanine dimer of Embodiment 66 was changed to 1 mmol for every 1 mol of vanadium phthalocyanine.

Embodiment 69

A photosensitive body was manufactured in the same manner as Embodiment 66, except that the amount of $\mu$ oxo iron phthalocyanine dimer of Embodiment 66 was changed to 100 mmol for every 1 mol of vanadium phthalocyanine.

Embodiment 70

A photosensitive body was manufactured in the same manner as Embodiment 66, except that the amount of $\mu$ oxo iron phthalocyanine dimer of Embodiment 66 was changed to 300 mmol for every 1 mol of vanadium phthalocyanine.

COMPARATIVE EXAMPLE 25

A photosensitive body was manufactured in the same manner as Embodiment 61, except that the amount of $\mu$ oxo iron phthalocyanine dimer of Embodiment 61 was changed to 50 mmol for every 1 mol of vanadium phthalocyanine.

COMPARATIVE EXAMPLE 26

A photosensitive body was manufactured in the same manner as Embodiment 61, except that the amount of $\mu$ oxo iron phthalocyanine dimer of Embodiment 61 was changed to 400 mmol for every 1 mol of vanadium phthalocyanine.

COMPARATIVE EXAMPLE 27

A photosensitive body was manufactured in the same manner as Embodiment 66, except that the amount of $\mu$ oxo iron phthalocyanine dimer of Embodiment 66 was changed to 50 mmol for every 1 mol of vanadium phthalocyanine.

COMPARATIVE EXAMPLE 28

A photosensitive body was manufactured in the same manner as Embodiment 66, except that the amount of $\mu$ oxo iron phthalocyanine dimer of Embodiment 66 was changed to 400 mmol for every 1 mol of vanadium phthalocyanine.

The electrical properties of the photosensitive bodies obtained in this manner were measured in the same manner as described above, and the retention rates (%) were obtained. The obtained results are shown in the following Table 8.

TABLE 8

| | Retention rate (%) | | Retention rate (%) |
|---|---|---|---|
| Embodiment 61 | 95.5 | Comparative example 25 | 88.9 |
| Embodiment 62 | 95.3 | Comparative example 26 | 88.6 |
| Embodiment 63 | 95.3 | Comparative example 27 | 88.7 |
| Embodiment 64 | 95.7 | Comparative example 28 | 88.4 |
| Embodiment 65 | 95.0 | | |
| Embodiment 66 | 95.8 | | |
| Embodiment 67 | 95.1 | | |
| Embodiment 68 | 95.2 | | |
| Embodiment 69 | 95.4 | | |
| Embodiment 70 | 95.6 | | |

As is clear from Table 8, all of the embodiments were good with high retention rates, but all of the comparative examples had lower retention rates compared to the embodiments.

Embodiment 71

A photosensitive body was manufactured in the same manner as Embodiment 31, except that the iron phthalocyanine of Embodiment 31 was changed to a niobium phthalocyanine synthesized according to a standard method.

Embodiment 72

A photosensitive body was manufactured in the same manner as Embodiment 71, except that the amount of $\mu$ oxo iron phthalocyanine dimer of Embodiment 71 was changed to 10 micromol for every 1 mol of niobium phthalocyanine.

Embodiment 73

A photosensitive body was manufactured in the same manner as Embodiment 71, except that the amount of $\mu$ oxo iron phthalocyanine dimer of Embodiment 71 was changed to 1 mmol for every 1 mol of niobium phthalocyanine.

Embodiment 74

A photosensitive body was manufactured in the same manner as Embodiment 71, except that the amount of μ oxo iron phthalocyanine dimer of Embodiment 71 was changed to 100 mmol for every 1 mol of niobium phthalocyanine.

Embodiment 75

A photosensitive body was manufactured in the same manner as Embodiment 71, except that the amount of μ oxo iron phthalocyanine dimer of Embodiment 71 was changed to 300 mmol for every 1 mol of niobium phthalocyanine.

Embodiment 76

A photosensitive body was manufactured in the same manner as Embodiment 71, except that after adding the μ oxo iron phthalocyanine dimer of Embodiment 71, this was treated by acid pasting with 96% sulfuric acid, and after rinsing with water, this was dried.

Embodiment 77

A photosensitive body was manufactured in the same manner as Embodiment 76, except that the amount of μ oxo iron phthalocyanine dimer of Embodiment 76 was changed to 10 micromol for every 1 mol of niobium phthalocyanine.

Embodiment 78

A photosensitive body was manufactured in the same manner as Embodiment 76, except that the amount of μ oxo iron phthalocyanine dimer of Embodiment 76 was changed to 1 mmol for every 1 mol of niobium phthalocyanine.

Embodiment 79

A photosensitive body was manufactured in the same manner as Embodiment 76, except that the amount of μ oxo iron phthalocyanine dimer of Embodiment 76 was changed to 100 mmol for every 1 mol of niobium phthalocyanine.

Embodiment 80

A photosensitive body was manufactured in the same manner as Embodiment 76, except that the amount of μ oxo iron phthalocyanine dimer of Embodiment 76 was changed to 300 mmol for every 1 mol of niobium phthalocyanine.

COMPARATIVE EXAMPLE 29

A photosensitive body was manufactured in the same manner as Embodiment 71, except that the amount of μ oxo iron phthalocyanine dimer of Embodiment 71 was changed to 50 mmol for every 1 mol of niobium phthalocyanine.

COMPARATIVE EXAMPLE 30

A photosensitive body was manufactured in the same manner as Embodiment 71, except that the amount of μ oxo iron phthalocyanine dimer of Embodiment 71 was changed to 400 mmol for every 1 mol of niobium phthalocyanine.

COMPARATIVE EXAMPLE 31

A photosensitive body was manufactured in the same manner as Embodiment 76, except that the amount of μ oxo iron phthalocyanine dimer of Embodiment 76 was changed to 50 mmol for every 1 mol of niobium phthalocyanine.

COMPARATIVE EXAMPLE 32

A photosensitive body was manufactured in the same manner as Embodiment 76, except that the amount of μ oxo iron phthalocyanine dimer of Embodiment 76 was changed to 400 mmol for every 1 mol of niobium phthalocyanine.

The electrical properties of the photosensitive bodies obtained in this manner were measured in the same manner as described above, and the retention rates (%) were obtained. The obtained results are shown in the following Table 9.

TABLE 9

| | Retention rate (%) | | Retention rate (%) |
|---|---|---|---|
| Embodiment 71 | 95.0 | Comparative example 29 | 89.3 |
| Embodiment 72 | 95.1 | Comparative example 30 | 88.1 |
| Embodiment 73 | 94.8 | Comparative example 31 | 88.2 |
| Embodiment 74 | 95.5 | Comparative example 32 | 89.7 |
| Embodiment 75 | 95.7 | | |
| Embodiment 76 | 95.2 | | |
| Embodiment 77 | 95.4 | | |
| Embodiment 78 | 94.9 | | |
| Embodiment 79 | 95.1 | | |
| Embodiment 80 | 95.2 | | |

As is clear from Table 9, all of the embodiments were good with high retention rates, but all of the comparative examples had lower retention rates compared to the embodiments.

Embodiment 81

A photosensitive body was manufactured in the same manner as Embodiment 31, except that the iron phthalocyanine of Embodiment 31 was changed to an indium phthalocyanine synthesized according to a standard method.

Embodiment 82

A photosensitive body was manufactured in the same manner as Embodiment 81, except that the amount of μ oxo iron phthalocyanine dimer of Embodiment 81 was changed to 10 micromol for every 1 mol of indium phthalocyanine.

Embodiment 83

A photosensitive body was manufactured in the same manner as Embodiment 81, except that the amount of μ oxo iron phthalocyanine dimer of Embodiment 81 was changed to 1 mmol for every 1 mol of indium phthalocyanine.

Embodiment 84

A photosensitive body was manufactured in the same manner as Embodiment 81, except that the amount of μ oxo iron phthalocyanine dimer of Embodiment 81 was changed to 100 mmol for every 1 mol of indium phthalocyanine.

Embodiment 85

A photosensitive body was manufactured in the same manner as Embodiment 81, except that the amount of μ oxo iron phthalocyanine dimer of Embodiment 81 was changed to 300 mmol for every 1 mol of indium phthalocyanine.

Embodiment 86

A photosensitive body was manufactured in the same manner as Embodiment 81, except that after adding the μ oxo iron phthalocyanine dimer of Embodiment 81, this was treated by acid pasting with 96% sulfuric acid, and after rinsing with water, this was dried.

Embodiment 87

A photosensitive body was manufactured in the same manner as Embodiment 86, except that the amount of μ oxo iron phthalocyanine dimer of Embodiment 86 was changed to 10 micromol for every 1 mol of indium phthalocyanine.

Embodiment 88

A photosensitive body was manufactured in the same manner as Embodiment 86, except that the amount of μ oxo iron phthalocyanine dimer of Embodiment 86 was changed to 1 mmol for every 1 mol of indium phthalocyanine.

Embodiment 89

A photosensitive body was manufactured in the same manner as Embodiment 86, except that the amount of μ oxo iron phthalocyanine dimer of Embodiment 86 was changed to 100 mmol for every 1 mol of indium phthalocyanine.

Embodiment 90

A photosensitive body was manufactured in the same manner as Embodiment 86, except that the amount of μ oxo iron phthalocyanine dimer of Embodiment 86 was changed to 300 mmol for every 1 mol of indium phthalocyanine.

COMPARATIVE EXAMPLE 33

A photosensitive body was manufactured in the same manner as Embodiment 81, except that the amount of $\mu$ oxo iron phthalocyanine dimer of Embodiment 81 was changed to 50 mmol for every 1 mol of indium phthalocyanine.

COMPARATIVE EXAMPLE 34

A photosensitive body was manufactured in the same manner as Embodiment 81, except that the amount of $\mu$ oxo iron phthalocyanine dimer of Embodiment 81 was changed to 400 mmol for every 1 mol of indium phthalocyanine.

COMPARATIVE EXAMPLE 35

A photosensitive body was manufactured in the same manner as Embodiment 86, except that the amount of $\mu$ oxo iron phthalocyanine dimer of Embodiment 86 was changed to 50 mmol for every 1 mol of indium phthalocyanine.

COMPARATIVE EXAMPLE 36

A photosensitive body was manufactured in the same manner as Embodiment 86, except that the amount of $\mu$ oxo iron phthalocyanine dimer of Embodiment 86 was changed to 400 mmol for every 1 mol of indium phthalocyanine.

The electrical properties of the photosensitive bodies obtained in this manner were measured in the same manner as described above, and the retention rates (%) were obtained. The obtained results are shown in the following Table 10.

TABLE 10

| | Retention rate (%) | | Retention rate (%) |
|---|---|---|---|
| Embodiment 81 | 95.3 | Comparative example 33 | 89.4 |
| Embodiment 82 | 95.0 | Comparative example 34 | 88.6 |
| Embodiment 83 | 94.9 | Comparative example 35 | 89.2 |
| Embodiment 84 | 95.2 | Comparative example 36 | 89.7 |
| Embodiment 85 | 95.4 | | |
| Embodiment 86 | 95.1 | | |
| Embodiment 87 | 95.5 | | |
| Embodiment 88 | 95.2 | | |
| Embodiment 89 | 95.4 | | |
| Embodiment 90 | 95.3 | | |

As is clear from Table 10, all of the embodiments were good with high retention rates, but all of the comparative examples had lower retention rates compared to the embodiments.

Embodiment 91

A photosensitive body was manufactured in the same manner as Embodiment 31, except that the iron phthalocyanine of Embodiment 31 was changed to a gallium phthalocyanine synthesized according to a standard method.

Embodiment 92

A photosensitive body was manufactured in the same manner as Embodiment 91, except that the amount of $\mu$ oxo iron phthalocyanine dimer of Embodiment 91 was changed to 10 micromol for every 1 mol of gallium phthalocyanine.

Embodiment 93

A photosensitive body was manufactured in the same manner as Embodiment 91, except that the amount of $\mu$ oxo iron phthalocyanine dimer of Embodiment 91 was changed to 1 mmol for every 1 mol of gallium phthalocyanine.

Embodiment 94

A photosensitive body was manufactured in the same manner as Embodiment 91, except that the amount of $\mu$ oxo iron phthalocyanine dimer of Embodiment 91 was changed to 100 mmol for every 1 mol of gallium phthalocyanine.

Embodiment 95

A photosensitive body was manufactured in the same manner as Embodiment 91, except that the amount of $\mu$ oxo iron phthalocyanine dimer of Embodiment 91 was changed to 300 mmol for every 1 mol of gallium phthalocyanine.

Embodiment 96

A photosensitive body was manufactured in the same manner as Embodiment 91, except that after adding the $\mu$ oxo iron phthalocyanine dimer of Embodiment 91, this was treated by acid pasting with 96% sulfuric acid, and after rinsing with water, this was dried.

Embodiment 97

A photosensitive body was manufactured in the same manner as Embodiment 96, except that the amount of $\mu$ oxo iron phthalocyanine dimer of Embodiment 96 was changed to 10 micromol for every 1 mol of gallium phthalocyanine.

Embodiment 98

A photosensitive body was manufactured in the same manner as Embodiment 96, except that the amount of $\mu$ oxo iron phthalocyanine dimer of Embodiment 96 was changed to 1 mmol for every 1 mol of gallium phthalocyanine.

Embodiment 99

A photosensitive body was manufactured in the same manner as Embodiment 96, except that the amount of $\mu$ oxo iron phthalocyanine dimer of Embodiment 96 was changed to 100 mmol for every 1 mol of gallium phthalocyanine.

Embodiment 100

A photosensitive body was manufactured in the same manner as Embodiment 96, except that the amount of $\mu$ oxo iron phthalocyanine dimer of Embodiment 96 was changed to 300 m-mol for every 1 mol of gallium phthalocyanine.

COMPARATIVE EXAMPLE 37

A photosensitive body was manufactured in the same manner as Embodiment 91, except that the amount of $\mu$ oxo iron phthalocyanine dimer of Embodiment 91 was changed to 50 mmol for every 1 mol of gallium phthalocyanine.

COMPARATIVE EXAMPLE 38

A photosensitive body was manufactured in the same manner as Embodiment 91, except that the amount of $\mu$ oxo iron phthalocyanine dimer of Embodiment 91 was changed to 400 mmol for every 1 mol of gallium phthalocyanine.

COMPARATIVE EXAMPLE 39

A photosensitive body was manufactured in the same manner as Embodiment 96, except that the amount of $\mu$ oxo iron phthalocyanine dimer of Embodiment 96 was changed to 50 mmol for every 1 mol of gallium phthalocyanine.

COMPARATIVE EXAMPLE 40

A photosensitive body was manufactured in the same manner as Embodiment 96, except that the amount of $\mu$ oxo iron phthalocyanine dimer of Embodiment 96 was changed to 400 mmol for every 1 mol of gallium phthalocyanine.

The electrical properties of the photosensitive bodies obtained in this manner were measured in the same manner as described above, and the retention rates (%) were obtained. The obtained results are shown in the following Table 11.

TABLE 11

| | Retention rate (%) | | Retention rate (%) |
|---|---|---|---|
| Embodiment 91 | 95.5 | Comparative example 37 | 88.4 |
| Embodiment 92 | 95.0 | Comparative example 38 | 88.1 |
| Embodiment 93 | 95.2 | Comparative example 39 | 88.2 |
| Embodiment 94 | 95.4 | Comparative example 40 | 87.9 |
| Embodiment 95 | 95.1 | | |
| Embodiment 96 | 95.2 | | |
| Embodiment 97 | 95.0 | | |
| Embodiment 98 | 95.3 | | |
| Embodiment 99 | 94.9 | | |
| Embodiment 100 | 95.2 | | |

As is clear from Table 11, all of the embodiments were good with high retention rates, but all of the comparative examples had lower retention rates compared to the embodiments.

Embodiment 101

A photosensitive body was manufactured in the same manner as Embodiment 31, except that the iron phthalocyanine of Embodiment 31 was changed to a germanium phthalocyanine synthesized according to a standard method.

Embodiment 102

A photosensitive body was manufactured in the same manner as Embodiment 101, except that the amount of $\mu$ oxo iron phthalocyanine dimer of Embodiment 101 was changed to 10 micromol for every 1 mol of germanium phthalocyanine.

Embodiment 103

A photosensitive body was manufactured in the same manner as Embodiment 101, except that the amount of $\mu$ oxo iron phthalocyanine dimer of Embodiment 101 was changed to 1 mmol for every 1 mol of germanium phthalocyanine.

Embodiment 104

A photosensitive body was manufactured in the same manner as Embodiment 101, except that the amount of $\mu$ oxo iron phthalocyanine dimer of Embodiment 101 was changed to 100 mmol for every 1 mol of germanium phthalocyanine.

Embodiment 105

A photosensitive body was manufactured in the same manner as Embodiment 101, except that the amount of $\mu$ oxo iron phthalocyanine dimer of Embodiment 101 was changed to 300 mmol for every 1 mol of germanium phthalocyanine.

Embodiment 106

A photosensitive body was manufactured in the same manner as Embodiment 101, except that after adding the $\mu$ oxo iron phthalocyanine dimer of Embodiment 101, this was treated by acid pasting with 96% sulfuric acid, and after rinsing with water, this was dried.

Embodiment 107

A photosensitive body was manufactured in the same manner as Embodiment 106, except that the amount of $\mu$ oxo iron phthalocyanine dimer of Embodiment 106 was changed to 10 micromol for every 1 mol of germanium phthalocyanine.

Embodiment 108

A photosensitive body was manufactured in the same manner as Embodiment 106, except that the amount of $\mu$ oxo iron phthalocyanine dimer of Embodiment 106 was changed to 1 mmol for every 1 mol of germanium phthalocyanine.

Embodiment 109

A photosensitive body was manufactured in the same manner as Embodiment 106, except that the amount of $\mu$ oxo iron phthalocyanine dimer of Embodiment 106 was changed to 100 mmol for every 1 mol of germanium phthalocyanine.

Embodiment 110

A photosensitive body was manufactured in the same manner as Embodiment 106, except that the amount of $\mu$ oxo iron phthalocyanine dimer of Embodiment 106 was changed to 300 mmol for every 1 mol of germanium phthalocyanine.

COMPARATIVE EXAMPLE 41

A photosensitive body was manufactured in the same manner as Embodiment 101, except that the amount of $\mu$ oxo iron phthalocyanine dimer of Embodiment 101 was changed to 50 mmol for every 1 mol of germanium phthalocyanine.

COMPARATIVE EXAMPLE 42

A photosensitive body was manufactured in the same manner as Embodiment 101, except that the amount of $\mu$ oxo iron phthalocyanine dimer of Embodiment 101 was changed to 400 mmol for every 1 mol of germanium phthalocyanine.

COMPARATIVE EXAMPLE 43

A photosensitive body was manufactured in the same manner as Embodiment 106, except that the amount of $\mu$ oxo iron phthalocyanine dimer of Embodiment 106 was changed to 50 mmol for every 1 mol of germanium phthalocyanine.

COMPARATIVE EXAMPLE 44

A photosensitive body was manufactured in the same manner as Embodiment 106, except that the amount of $\mu$ oxo iron phthalocyanine dimer of Embodiment 106 was changed to 400 mmol for every 1 mol of germanium phthalocyanine.

The electrical properties of the photosensitive bodies obtained in this manner were measured in the same manner as described above, and the retention rates (%) were obtained. The obtained results are shown in the following Table 12.

TABLE 12

| | Retention rate (%) | | Retention rate (%) |
|---|---|---|---|
| Embodiment 101 | 95.2 | Comparative example 41 | 88.3 |
| Embodiment 102 | 95.0 | Comparative example 42 | 88.0 |
| Embodiment 103 | 95.3 | Comparative example 43 | 88.5 |
| Embodiment 104 | 95.2 | Comparative example 44 | 88.7 |
| Embodiment 105 | 95.4 | | |
| Embodiment 106 | 94.8 | | |
| Embodiment 107 | 95.1 | | |
| Embodiment 108 | 95.0 | | |
| Embodiment 109 | 95.2 | | |
| Embodiment 110 | 95.3 | | |

As is clear from Table 12, all of the embodiments were good with high retention rates, but all of the comparative examples had lower retention rates compared to the embodiments.

Embodiment 111

A photosensitive body was manufactured in the same manner as Embodiment 31, except that the iron phthalocyanine of Embodiment 31 was changed to a tin phthalocyanine synthesized according to a standard method.

Embodiment 112

A photosensitive body was manufactured in the same manner as Embodiment 111, except that the amount of $\mu$ oxo iron phthalocyanine dimer of Embodiment 111 was changed to 10 micromol for every 1 mol of tin phthalocyanine.

Embodiment 113

A photosensitive body was manufactured in the same manner as Embodiment 111, except that the amount of $\mu$ oxo iron phthalocyanine dimer of Embodiment 111 was changed to 1 mmol for every 1 mol of tin phthalocyanine.

Embodiment 114

A photosensitive body was manufactured in the same manner as Embodiment 111, except that the amount of $\mu$ oxo iron phthalocyanine dimer of Embodiment 111 was changed to 100 mmol for every 1 mol of tin phthalocyanine.

Embodiment 115

A photosensitive body was manufactured in the same manner as Embodiment 111, except that the amount of $\mu$ oxo iron phthalocyanine dimer of Embodiment 111 was changed to 300 mmol for every 1 mol of tin phthalocyanine.

Embodiment 116

A photosensitive body was manufactured in the same manner as Embodiment 111, except that after adding the $\mu$ oxo iron phthalocyanine dimer of Embodiment 111, this was treated by acid pasting with 96% sulfuric acid, and after rinsing with water, this was dried.

Embodiment 117

A photosensitive body was manufactured in the same manner as Embodiment 116, except that the amount of $\mu$ oxo iron phthalocyanine dimer of Embodiment 116 was changed to 10 micromol for every 1 mol of tin phthalocyanine.

Embodiment 118

A photosensitive body was manufactured in the same manner as Embodiment 116, except that the amount of $\mu$ oxo iron phthalocyanine dimer of Embodiment 116 was changed to 1 mmol for every 1 mol of tin phthalocyanine.

Embodiment 119

A photosensitive body was manufactured in the same manner as Embodiment 116, except that the amount of $\mu$ oxo iron phthalocyanine dimer of Embodiment 116 was changed to 100 mmol for every 1 mol of tin phthalocyanine.

Embodiment 120

A photosensitive body was manufactured in the same manner as Embodiment 116, except that the amount of $\mu$ oxo iron phthalocyanine dimer of Embodiment 116 was changed to 300 mmol for every 1 mol of tin phthalocyanine.

COMPARATIVE EXAMPLE 45

A photosensitive body was manufactured in the same manner as Embodiment 111, except that the amount of $\mu$ oxo iron phthalocyanine dimer of Embodiment 111 was changed to 50 mnol for every 1 mol of tin phthalocyanine.

COMPARATIVE EXAMPLE 46

A photosensitive body was manufactured in the same manner as Embodiment 111, except that the amount of $\mu$ oxo iron phthalocyanine dimer of Embodiment 111 was changed to 400 mmol for every 1 mol of tin phthalocyanine.

COMPARATIVE EXAMPLE 47

A photosensitive body was manufactured in the same manner as Embodiment 116, except that the amount of $\mu$ oxo iron phthalocyanine dimer of Embodiment 116 was changed to 50 mmol for every 1 mol of tin phthalocyanine.

COMPARATIVE EXAMPLE 48

A photosensitive body was manufactured in the same manner as Embodiment 116, except that the amount of $\mu$ oxo iron phthalocyanine dimer of Embodiment 116 was changed to 400 mmol for every 1 mol of tin phthalocyanine.

The electrical properties of the photosensitive bodies obtained in this manner were measured in the same manner as described above, and the retention rates (%) were obtained. The obtained results are shown in the following Table 13.

TABLE 13

| | Retention rate (%) | | Retention rate (%) |
|---|---|---|---|
| Embodiment 111 | 95.2 | Comparative example 45 | 89.0 |
| Embodiment 112 | 95.0 | Comparative example 46 | 88.2 |
| Embodiment 113 | 95.1 | Comparative example 47 | 89.2 |
| Embodiment 114 | 95.4 | Comparative example 48 | 88.5 |
| Embodiment 115 | 95.2 | | |
| Embodiment 116 | 95.5 | | |
| Embodiment 117 | 95.1 | | |
| Embodiment 118 | 94.9 | | |
| Embodiment 119 | 95.2 | | |
| Embodiment 120 | 95.1 | | |

As is clear from Table 13, all of the embodiments were good with high retention rates, but all of the comparative examples had lower retention rates compared to the embodiments.

Embodiment 121

A photosensitive body was manufactured in the same manner as Embodiment 11, except that the titanyl oxo phthalocyanine of Embodiment 11 was changed to a manganese phthalocyanine synthesized according to a standard method.

Embodiment 122

A photosensitive body was manufactured in the same manner as Embodiment 121, except that the amount of $\mu$ oxo manganese phthalocyanine dimer of Embodiment 121 was changed to 10 micromol for every 1 mol of manganese phthalocyanine.

Embodiment 123

A photosensitive body was manufactured in the same manner as Embodiment 121, except that the amount of $\mu$ oxo manganese phthalocyanine dimer of Embodiment 121 was changed to 1 mmol for every 1 mol of manganese phthalocyanine.

Embodiment 124

A photosensitive body was manufactured in the same manner as Embodiment 121, except that the amount of $\mu$ oxo manganese phthalocyanine dimer of Embodiment 121 was changed to 100 mmol for every 1 mol of manganese phthalocyanine.

Embodiment 125

A photosensitive body was manufactured in the same manner as Embodiment 121, except that the amount of $\mu$ oxo manganese phthalocyanine dimer of Embodiment 121 was changed to 300 mmol for every 1 mol of manganese phthalocyanine.

Embodiment 126

A photosensitive body was manufactured in the same manner as Embodiment 121, except that after adding the $\mu$ oxo manganese phthalocyanine dimer of Embodiment 121, this was treated by acid pasting with 96% sulfuric acid, and after rinsing with water, this was dried.

Embodiment 127

A photosensitive body was manufactured in the same manner as Embodiment 126, except that the amount of $\mu$ oxo manganese phthalocyanine dimer of Embodiment 126 was changed to 10 micromol for every 1 mol of manganese phthalocyanine.

Embodiment 128

A photosensitive body was manufactured in the same manner as Embodiment 126, except that the amount of $\mu$ oxo manganese phthalocyanine dimer of Embodiment 126 was changed to 1 mmol for every 1 mol of manganese phthalocyanine.

Embodiment 129

A photosensitive body was manufactured in the same manner as Embodiment 126, except that the amount of $\mu$ oxo manganese phthalocyanine dimer of Embodiment 126 was changed to 100 mmol for every 1 mol of manganese phthalocyanine.

Embodiment 130

A photosensitive body was manufactured in the same manner as Embodiment 126, except that the amount of $\mu$ oxo manganese phthalocyanine dimer of Embodiment 126 was changed to 300 mmol for every 1 mol of manganese phthalocyanine.

COMPARATIVE EXAMPLE 49

A photosensitive body was manufactured in the same manner as Embodiment 121, except that the amount of $\mu$ oxo manganese phthalocyanine dimer of Embodiment 121 was changed to 50 mmol for every 1 mol of manganese phthalocyanine.

COMPARATIVE EXAMPLE 50

A photosensitive body was manufactured in the same manner as Embodiment 121, except that the amount of $\mu$ oxo manganese phthalocyanine dimer of Embodiment 121 was changed to 400 mmol for every 1 mol of manganese phthalocyanine.

COMPARATIVE EXAMPLE 51

A photosensitive body was manufactured in the same manner as Embodiment 126, except that the amount of $\mu$ oxo manganese phthalocyanine dimer of Embodiment 126 was changed to 50 mmol for every 1 mol of manganese phthalocyanine.

COMPARATIVE EXAMPLE 52

A photosensitive body was manufactured in the same manner as Embodiment 126, except that the amount of $\mu$ oxo manganese phthalocyanine dimer of Embodiment 126 was changed to 400 mmol for every 1 mol of manganese phthalocyanine.

The electrical properties of the photosensitive bodies obtained in this manner were measured in the same manner as described above, and the retention rates (%) were obtained. The obtained results are shown in the following Table 14.

TABLE 14

| | Retention rate (%) | | Retention rate (%) |
|---|---|---|---|
| Embodiment 121 | 95.2 | Comparative example 49 | 88.9 |
| Embodiment 122 | 95.1 | Comparative example 50 | 88.3 |
| Embodiment 123 | 94.8 | Comparative example 51 | 89.2 |
| Embodiment 124 | 95.2 | Comparative example 52 | 88.7 |
| Embodiment 125 | 95.2 | | |
| Embodiment 126 | 95.4 | | |
| Embodiment 127 | 95.0 | | |
| Embodiment 128 | 95.1 | | |
| Embodiment 129 | 95.3 | | |
| Embodiment 130 | 95.2 | | |

As is clear from Table 14, all of the embodiments were good with high retention rates, but all of the comparative examples had lower retention rates compared to the embodiments.

Embodiment 131

A photosensitive body was manufactured in the same manner as Embodiment 1, except that the $\mu$ oxo titanyl phthalocyanine dimer of Embodiment 1 was changed to a $\mu$ dysprosium phthalocyanine dimer synthesized according to a standard method.

Embodiment 132

A photosensitive body was manufactured in the same manner as Embodiment 131, except that the amount of $\mu$ dysprosium phthalocyanine dimer of Embodiment 131 was changed to 10 micromol for every 1 mol of titanyl oxo phthalocyanine.

Embodiment 133

A photosensitive body was manufactured in the same manner as Embodiment 131, except that the amount of $\mu$ dysprosium phthalocyanine dimer of Embodiment 131 was changed to 1 mmol for every 1 mol of titanyl oxo phthalocyanine.

Embodiment 134

A photosensitive body was manufactured in the same manner as Embodiment 131, except that the amount of $\mu$ dysprosium phthalocyanine dimer of Embodiment 131 was changed to 100 mmol for every 1 mol of titanyl oxo phthalocyanine.

Embodiment 135

A photosensitive body was manufactured in the same manner as Embodiment 131, except that the amount of $\mu$ dysprosium phthalocyanine dimer of Embodiment 131 was changed to 300 mmol for every 1 mol of titanyl oxo phthalocyanine.

Embodiment 136

A photosensitive body was manufactured in the same manner as Embodiment 131, except that after adding the $\mu$ dysprosium phthalocyanine dimer of Embodiment 131, this was treated by acid pasting with 96% sulfuric acid, and after rinsing with water, this was dried.

Embodiment 137

A photosensitive body was manufactured in the same manner as Embodiment 136, except that the amount of $\mu$ dysprosium phthalocyanine dimer of Embodiment 136 was changed to 10 micromol for every 1 mol of titanyl oxo phthalocyanine.

Embodiment 138

A photosensitive body was manufactured in the same manner as Embodiment 136, except that the amount of $\mu$ dysprosium phthalocyanine dimer of Embodiment 136 was changed to 1 mmol for every 1 mol of titanyl oxo phthalocyanine.

Embodiment 139

A photosensitive body was manufactured in the same manner as Embodiment 136, except that the amount of $\mu$ dysprosium phthalocyanine dimer of Embodiment 136 was changed to 100 mmol for every 1 mol of titanyl oxo phthalocyanine.

Embodiment 140

A photosensitive body was manufactured in the same manner as Embodiment 136, except that the amount of $\mu$ dysprosium phthalocyanine dimer of Embodiment 136 was changed to 300 mmol for every 1 mol of titanyl oxo phthalocyanine.

COMPARATIVE EXAMPLE 53

A photosensitive body was manufactured in the same manner as Embodiment 131, except that the amount of $\mu$ dysprosium phthalocyanine dimer of Embodiment 131 was changed to 50 mmol for every 1 mol of titanyl oxo phthalocyanine.

COMPARATIVE EXAMPLE 54

A photosensitive body was manufactured in the same manner as Embodiment 131, except that the amount of $\mu$ dysprosium phthalocyanine dimer of Embodiment 131 was changed to 400 mmol for every 1 mol of titanyl oxo phthalocyanine.

COMPARATIVE EXAMPLE 55

A photosensitive body was manufactured in the same manner as Embodiment 136, except that the amount of $\mu$ dysprosium phthalocyanine dimer of Embodiment 136 was changed to 50 mmol for every 1 mol of titanyl oxo phthalocyanine.

COMPARATIVE EXAMPLE 56

A photosensitive body was manufactured in the same manner as Embodiment 136, except that the amount of $\mu$ dysprosium phthalocyanine dimer of Embodiment 136 was changed to 400 mmol for every 1 mol of titanyl oxo phthalocyanine.

The electrical properties of the photosensitive bodies obtained in this manner were measured in the same manner as described above, and the retention rates (%) were obtained. The obtained results are shown in the following Table 15.

TABLE 15

| | Retention rate (%) | | Retention rate (%) |
|---|---|---|---|
| Embodiment 131 | 98.0 | Comparative example 53 | 91.1 |
| Embodiment 132 | 97.5 | Comparative example 54 | 90.8 |
| Embodiment 133 | 97.3 | Comparative example 55 | 90.7 |
| Embodiment 134 | 97.6 | Comparative example 56 | 91.3 |
| Embodiment 135 | 97.5 | | |
| Embodiment 136 | 97.8 | | |
| Embodiment 137 | 97.1 | | |
| Embodiment 138 | 97.2 | | |
| Embodiment 139 | 97.5 | | |
| Embodiment 140 | 97.6 | | |

As is clear from Table 15, all of the embodiments were good with high retention rates, but all of the comparative examples had lower retention rates compared to the embodiments.

Embodiment 141

A photosensitive body was manufactured in the same manner as Embodiment 31, except that the iron phthalocyanine of Embodiment 31 was changed to a metal-free phthalocyanine synthesized according to a standard method.

Embodiment 142

A photosensitive body was manufactured in the same manner as Embodiment 141, except that the amount of $\mu$ oxo iron phthalocyanine dimer of Embodiment 141 was changed to 10 micromol for every 1 mol of metal-free phthalocyanine.

Embodiment 143

A photosensitive body was manufactured in the same manner as Embodiment 141, except that the amount of $\mu$ oxo iron phthalocyanine dimer of Embodiment 141 was changed to 1 mmol for every 1 mol of metal-free phthalocyanine.

Embodiment 144

A photosensitive body was manufactured in the same manner as Embodiment 141, except that the amount of $\mu$ oxo iron phthalocyanine dimer of Embodiment 141 was changed to 100 mmol for every 1 mol of metal-free phthalocyanine.

Embodiment 145

A photosensitive body was manufactured in the same manner as Embodiment 141, except that the amount of $\mu$ oxo iron phthalocyanine dimer of Embodiment 141 was changed to 300 mmol for every 1 mol of metal-free phthalocyanine.

Embodiment 146

A photosensitive body was manufactured in the same manner as Embodiment 141, except that after adding the $\mu$ oxo iron phthalocyanine dimer of Embodiment 141, this was treated by acid pasting with 96% sulfuric acid, and after rinsing with water, this was dried.

Embodiment 147

A photosensitive body was manufactured in the same manner as Embodiment 146, except that the amount of $\mu$ oxo iron phthalocyanine dimer of Embodiment 146 was changed to 10 micromol for every 1 mol of metal-free phthalocyanine.

Embodiment 148

A photosensitive body was manufactured in the same manner as Embodiment 146, except that the amount of $\mu$ oxo iron phthalocyanine dimer of Embodiment 146 was changed to 1 mmol for every 1 mol of metal-free phthalocyanine.

Embodiment 149

A photosensitive body was manufactured in the same manner as Embodiment 146, except that the amount of $\mu$ oxo iron phthalocyanine dimer of Embodiment 146 was changed to 100 mmol for every 1 mol of metal-free phthalocyanine.

Embodiment 150

A photosensitive body was manufactured in the same manner as Embodiment 146, except that the amount of $\mu$ oxo iron phthalocyanine dimer of Embodiment 146 was changed to 300 mmol for every 1 mol of metal-free phthalocyanine.

COMPARATIVE EXAMPLE 57

A photosensitive body was manufactured in the same manner as Embodiment 141, except that the amount of $\mu$ oxo iron phthalocyanine dimer of Embodiment 141 was changed to 50 mmol for every 1 mol of metal-free phthalocyanine.

COMPARATIVE EXAMPLE 58

A photosensitive body was manufactured in the same manner as Embodiment 141, except that the amount of $\mu$ oxo iron phthalocyanine dimer of Embodiment 141 was changed to 400 mmol for every 1 mol of metal-free phthalocyanine.

COMPARATIVE EXAMPLE 59

A photosensitive body was manufactured in the same manner as Embodiment 146, except that the amount of $\mu$ oxo iron phthalocyanine dimer of Embodiment 146 was changed to 50 mmol for every 1 mol of metal-free phthalocyanine.

COMPARATIVE EXAMPLE 60

A photosensitive body was manufactured in the same manner as Embodiment 146, except that the amount of $\mu$ oxo iron phthalocyanine dimer of Embodiment 146 was changed to 400 mmol for every 1 mol of metal-free phthalocyanine.

The electrical properties of the photosensitive bodies obtained in this manner were measured in the same manner as described above, and the retention rates (%) were obtained. The obtained results are shown in the following Table 16.

TABLE 16

| | Retention rate (%) | | Retention rate (%) |
|---|---|---|---|
| Embodiment 141 | 96.4 | Comparative example 57 | 91.0 |
| Embodiment 142 | 96.6 | Comparative example 58 | 89.4 |
| Embodiment 143 | 96.3 | Comparative example 59 | 90.7 |
| Embodiment 144 | 96.7 | Comparative example 60 | 89.7 |
| Embodiment 145 | 96.1 | | |
| Embodiment 146 | 96.5 | | |
| Embodiment 147 | 96.9 | | |
| Embodiment 148 | 96.6 | | |
| Embodiment 149 | 96.4 | | |
| Embodiment 150 | 96.2 | | |

As is clear from Table 16, all of the embodiments were good with high retention rates, but all of the comparative examples had lower retention rates compared to the embodiments.

Embodiment 151

A photosensitive body was manufactured in the same manner as Embodiment 1, except that, instead of the $\mu$ oxo titanyl phthalocyanine dimer, a 29H, 31H-phthalocyanine titanyl complex synthesized according to the previous reference, Sens. Actuators, B(1998), B48(1~3),333~338, was added to the titanyl oxo phthalocyanine which was obtained in step 5 of the formation of charge generating layer of Embodiment 1, and a charge generating layer was formed using the coating solution containing the generated titanyl oxo phthalocyanine that contains 29H, 31H-phthalocyanine titanyl complex.

Embodiment 152

A photosensitive body was manufactured in the same manner as Embodiment 151, except that the amount of 29H, 31 H-phthalocyanine titanyl complex of Embodiment 151 was changed to 10 micromol for every 1 mol of titanyl oxo phthalocyanine.

Embodiment 153

A photosensitive body was manufactured in the same manner as Embodiment 151, except that the amount of 29H, 31H-phthalocyanine titanyl complex of Embodiment 151 was changed to 1 mmol for every 1 mol of titanyl oxo phthalocyanine.

Embodiment 154

A photosensitive body was manufactured in the same manner as Embodiment 151, except that the amount of 29H, 31H-phthalocyanine titanyl complex of Embodiment 151 was changed to 100 mmol for every 1 mol of titanyl oxo phthalocyanine.

Embodiment 155

A photosensitive body was manufactured in the same manner as Embodiment 151, except that the amount of 29H, 31H-phthalocyanine titanyl complex of Embodiment 151 was changed to 300 mmol for every 1 mol of titanyl oxo phthalocyanine.

Embodiment 156

A photosensitive body was manufactured in the same manner as Embodiment 151, except that after adding the 29H, 31 H-phthalocyanine titanyl complex of Embodiment 151, this was treated by acid pasting with 96% sulfuric acid, and after rinsing with water, this was dried.

Embodiment 157

A photosensitive body was manufactured in the same manner as Embodiment 156, except that the amount of 29H, 31H-phthalocyanine titanyl complex of Embodiment 156 was changed to 10 micromol for every 1 mol of titanyl oxo phthalocyanine.

Embodiment 158

A photosensitive body was manufactured in the same manner as Embodiment 156, except that the amount of 29H, 31H-phthalocyanine titanyl complex of Embodiment 156 was changed to 1 mmol for every 1 mol of titanyl oxo phthalocyanine.

Embodiment 159

A photosensitive body was manufactured in the same manner as Embodiment 156, except that the amount of 29H, 31H-phthalocyanine titanyl complex of Embodiment 156 was changed to 1100 mmol for every 1 mol of titanyl oxo phthalocyanine.

Embodiment 160

A photosensitive body was manufactured in the same manner as Embodiment 156, except that the amount of 29H, 31H-phthalocyanine titanyl complex of Embodiment 156 was changed to 300 mmol for every 1 mol of titanyl oxo phthalocyanine.

COMPARATIVE EXAMPLE 61

A photosensitive body was manufactured in the same manner as Embodiment 151, except that the amount of 29H, 31H-phthalocyanine titanyl complex of Embodiment 151 was changed to 50 mmol for every 1 mol of titanyl oxo phthalocyanine.

COMPARATIVE EXAMPLE 62

A photosensitive body was manufactured in the same manner as Embodiment 151, except that the amount of 29H, 31 H-phthalocyanine titanyl complex of Embodiment 151 was changed to 400 mmol for every 1 mol of titanyl oxo phthalocyanine.

COMPARATIVE EXAMPLE 63

A photosensitive body was manufactured in the same manner as Embodiment 156, except that the amount of 29H, 31H-phthalocyanine titanyl complex of Embodiment 156 was changed to 50 mmol for every 1 mol of titanyl oxo phthalocyanine.

COMPARATIVE EXAMPLE 64

A photosensitive body was manufactured in the same manner as Embodiment 156, except that the amount of 29H, 31H-phthalocyanine titanyl complex of Embodiment 156 was changed to 400 mmol for every 1 mol of titanyl oxo phthalocyanine.

The electrical properties of the photosensitive bodies obtained in this manner were measured using an electrostatic recording paper test device (EPA-8200™ manufactured by Kawaguchi Denki Seisakujo). The photosensitive body was charged to a surface electric potential of −600V by a corotron in the dark. This was left in the dark for 5 seconds, and the retention rate (%) of electric potential during that time was measured. The obtained results are shown in Table 17 below.

TABLE 17

| | Retention rate (%) | | Retention rate (%) |
|---|---|---|---|
| Embodiment 151 | 98.1 | Comparative example 61 | 91.7 |
| Embodiment 152 | 97.7 | Comparative example 62 | 90.2 |
| Embodiment 153 | 97.6 | Comparative example 63 | 91.1 |
| Embodiment 154 | 97.8 | Comparative example 64 | 90.6 |

TABLE 17-continued

| | Retention rate (%) | | Retention rate (%) |
|---|---|---|---|
| Embodiment 155 | 97.3 | | |
| Embodiment 156 | 97.8 | | |
| Embodiment 157 | 98.0 | | |
| Embodiment 158 | 97.4 | | |
| Embodiment 159 | 97.2 | | |
| Embodiment 160 | 97.5 | | |

As is clear from Table 17, all of the embodiments were good with high retention rates, but all of the comparative examples had lower retention rates compared to the embodiments.

Embodiment 161

A photosensitive body was manufactured in the same manner as Embodiment 151, except that the titanyl oxo phthalocyanine of Embodiment 151 was changed to an indium phthalocyanine synthesized according to a standard method.

Embodiment 162

A photosensitive body was manufactured in the same manner as Embodiment 161, except that the amount of 29H, 31H-phthalocyanine titanyl complex of Embodiment 161 was changed to 10 micromol for every 1 mol of indium phthalocyanine.

Embodiment 163

A photosensitive body was manufactured in the same manner as Embodiment 161, except that the amount of 29H, 31 H-phthalocyanine titanyl complex of Embodiment 161 was changed to 1 mmol for every 1 mol of indium phthalocyanine.

Embodiment 164

A photosensitive body was manufactured in the same manner as Embodiment 161, except that the amount of 29H, 31H-phthalocyanine titanyl complex of Embodiment 161 was changed to 100 mmol for every 1 mol of indium phthalocyanine.

Embodiment 165

A photosensitive body was manufactured in the same manner as Embodiment 161, except that the amount of 29H, 31 H-phthalocyanine titanyl complex of Embodiment 161 was changed to 300 mmol for every 1 mol of indium phthalocyanine.

Embodiment 166

A photosensitive body was manufactured in the same manner as Embodiment 161, except that after adding the 29H, 31 H-phthalocyanine titanyl complex of Embodiment 161, this was treated by acid pasting with 96% sulfuric acid, and after rinsing with water, this was dried.

Embodiment 167

A photosensitive body was manufactured in the same manner as Embodiment 166, except that the amount of 29H, 31 H-phthalocyanine titanyl complex of Embodiment 166 was changed to 10 micromol for every 1 mol of indium phthalocyanine.

Embodiment 168

A photosensitive body was manufactured in the same manner as Embodiment 166, except that the amount of 29H, 31H-phthalocyanine titanyl complex of Embodiment 166 was changed to 1 mmol for every 1 mol of indium phthalocyanine.

Embodiment 169

A photosensitive body was manufactured in the same manner as Embodiment 166, except that the amount of 29H, 31 H-phthalocyanine titanyl complex of Embodiment 166 was changed to 100 mmol for every 1 mol of indium phthalocyanine.

Embodiment 170

A photosensitive body was manufactured in the same manner as Embodiment 166, except that the amount of 29H, 31H-phthalocyanine titanyl complex of Embodiment 166 was changed to 300 mmol for every 1 mol of indium phthalocyanine.

COMPARATIVE EXAMPLE 65

A photosensitive body was manufactured in the same manner as Embodiment 161, except that the amount of 29H, 31 H-phthalocyanine titanyl complex of Embodiment 161 was changed to 50 mmol for every 1 mol of indium phthalocyanine.

COMPARATIVE EXAMPLE 66

A photosensitive body was manufactured in the same manner as Embodiment 161, except that the amount of 29H, 31 H-phthalocyanine titanyl complex of Embodiment 161 was changed to 400 mmol for every 1 mol of indium phthalocyanine.

COMPARATIVE EXAMPLE 67

A photosensitive body was manufactured in the same manner as Embodiment 166, except that the amount of 29H, 31 H-phthalocyanine titanyl complex of Embodiment 166 was changed to 50 mmol for every 1 mol of indium phthalocyanine.

COMPARATIVE EXAMPLE 68

A photosensitive body was manufactured in the same manner as Embodiment 166, except that the amount of 29H, 31H-phthalocyanine titanyl complex of Embodiment 166 was changed to 400 mmol for every 1 mol of indium phthalocyanine.

The electrical properties of the photosensitive bodies obtained in this manner were measured using an electrostatic recording paper test device (EPA-8200™ manufactured by Kawaguchi Denki Seisakujo). The photosensitive body was charged to a surface electric potential of −600V by a corotron in the dark. This was left in the dark for 5 seconds, and the retention rate (%) of electric potential during that time was measured. The obtained results are shown in Table 18 below.

TABLE 18

| | Retention rate (%) | | Retention rate (%) |
|---|---|---|---|
| Embodiment 161 | 96.1 | Comparative example 65 | 90.3 |
| Embodiment 162 | 95.4 | Comparative example 66 | 89.2 |
| Embodiment 163 | 94.9 | Comparative example 67 | 90.0 |
| Embodiment 164 | 95.3 | Comparative example 68 | 89.4 |
| Embodiment 165 | 95.4 | | |
| Embodiment 166 | 95.5 | | |
| Embodiment 167 | 95.1 | | |
| Embodiment 168 | 95.0 | | |
| Embodiment 169 | 94.8 | | |
| Embodiment 170 | 95.2 | | |

As is clear from Table 18, all of the embodiments were good with high retention rates, but all of the comparative examples had lower retention rates compared to the embodiments.

Embodiment 171

A photosensitive body was manufactured in the same manner as Embodiment 151, except that the 29H, 31H-phthalocyanine titanyl complex of Embodiment 151 was changed to a tetraazacyclodocosyne complex synthesized according to the aforementioned reference (Capobianchi, A. et al, Inorg. Chem. (1993), 32(21), 4605–11).

Embodiment 172

A photosensitive body was manufactured in the same manner as Embodiment 171, except that the amount of tetraazacyclodocosyne complex of Embodiment 171 was changed to 10 micromol for every 1 mol of titanyl oxo phthalocyanine.

Embodiment 173

A photosensitive body was manufactured in the same manner as Embodiment 171, except that the amount of tetraazacyclodocosyne complex of Embodiment 171 was changed to 1 mmol for every 1 mol of titanyl oxo phthalocyanine.

Embodiment 174

A photosensitive body was manufactured in the same manner as Embodiment 171, except that the amount of tetraazacyclodocosyne complex of Embodiment 171 was changed to 100 mmol for every 1 mol of titanyl oxo phthalocyanine.

Embodiment 175

A photosensitive body was manufactured in the same manner as Embodiment 171, except that the amount of tetraazacyclodocosyne complex of Embodiment 171 was changed to 300 mmol for every 1 mol of titanyl oxo phthalocyanine.

Embodiment 176

A photosensitive body was manufactured in the same manner as Embodiment 171, except that after adding the tetraazacyclodocosyne complex of Embodiment 171, this was treated by acid pasting with 96% sulfuric acid, and after rinsing with water, this was dried.

Embodiment 177

A photosensitive body was manufactured in the same manner as Embodiment 176, except that the amount of tetraazacyclodocosyne complex of Embodiment 176 was changed to 10 micromol for every 1 mol of titanyl oxo phthalocyanine.

Embodiment 178

A photosensitive body was manufactured in the same manner as Embodiment 176, except that the amount of tetraazacyclodocosyne complex of Embodiment 176 was changed to 1 mmol for every 1 mol of titanyl oxo phthalocyanine.

Embodiment 179

A photosensitive body was manufactured in the same manner as Embodiment 176, except that the amount of tetraazacyclodocosyne complex of Embodiment 176 was changed to 100 mmol for every 1 mol of titanyl oxo phthalocyanine.

Embodiment 180

A photosensitive body was manufactured in the same manner as Embodiment 176, except that the amount of tetraazacyclodocosyne complex of Embodiment 176 was changed to 300 mmol for every 1 mol of titanyl oxo phthalocyanine.

COMPARATIVE EXAMPLE 69

A photosensitive body was manufactured in the same manner as Embodiment 171, except that the amount of tetraazacyclodocosyne complex of Embodiment 171 was changed to 50 mmol for every 1 mol of titanyl oxo phthalocyanine.

COMPARATIVE EXAMPLE 70

A photosensitive body was manufactured in the same manner as Embodiment 171, except that the amount of tetraazacyclodocosyne complex of Embodiment 171 was changed to 400 mmol for every 1 mol of titanyl oxo phthalocyanine.

COMPARATIVE EXAMPLE 71

A photosensitive body was manufactured in the same manner as Embodiment 176, except that the amount of tetraazacyclodocosyne complex of Embodiment 176 was changed to 50 mmol for every 1 mol of titanyl oxo phthalocyanine.

COMPARATIVE EXAMPLE 72

A photosensitive body was manufactured in the same manner as Embodiment 176, except that the amount of tetraazacyclodocosyne complex of Embodiment 176 was changed to 400 mmol for every 1 mol of titanyl oxo phthalocyanine.

The electrical properties of the photosensitive bodies obtained in this manner were measured using an electrostatic recording paper test device (EPA-8200™ manufactured by Kawaguchi Denki Seisakujo). The photosensitive body was charged to a surface electric potential of −600V by a corotron in the dark. This was left in the dark for 5 seconds, and the retention rate (%) of electric potential during that time was measured. The obtained results are shown in Table 19 below.

TABLE 19

| | Retention rate (%) | | Retention rate (%) |
|---|---|---|---|
| Embodiment 171 | 98.3 | Comparative example 69 | 90.8 |
| Embodiment 172 | 98.1 | Comparative example 70 | 89.7 |
| Embodiment 173 | 97.9 | Comparative example 71 | 91.0 |
| Embodiment 174 | 98.0 | Comparative example 72 | 89.4 |
| Embodiment 175 | 97.8 | | |
| Embodiment 176 | 98.0 | | |
| Embodiment 177 | 97.6 | | |
| Embodiment 178 | 98.2 | | |
| Embodiment 179 | 97.6 | | |
| Embodiment 180 | 97.7 | | |

As is clear from Table 19, all of the embodiments were good with high retention rates, but all of the comparative examples had lower retention rates compared to the embodiments.

According to the present invention, a photosensitive layer of a conductive substrate contains at least a phthalocyanine compound as a photoconductive material, and in addition, contains a phthalocyanine dimer compound at 100 nmol or greater and 300 mmol or less for every 1 mol of the phthalocyanine compound. As a result, an electrophotography photosensitive body with excellent electric potential retention can be achieved.

In addition, according to the present invention, a coating solution for forming a photosensitive layer on top of a conductive substrate contains a phthalocyanine compound and a phthalocyanine dimer compound, and the content of the phthalocyanine dimer compound is 100 mmol or greater and 300 mmol or less for every 1 mol of the phthalocyanine. As a result, a manufacturing method for an electrophotography photosensitive body with excellent electric potential retention can be provided.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotography photosensitive body comprising:

a conductive substrate;

a photosensitive layer on said conductive substrate;

said photosensitive layer including a phthalocyanine compound and a phthalocyanine dimer;

said phthalocyanine dimer being present in from about 100 nmol to about 300 mmol per 1 mol of said phthalocyanine compound; and said phthalocyanine dimer having a Pc—M—Q—M—Pc construction, wherein Pc represents a phthalocyanine ring, M represents an element with an oxidation number of +3 or greater, and O represents an oxygen atom.

2. The electrophotography photosensitive body according to claim 1, wherein:

a phthalocyanine compound that forms said phthalocyanine dimer is titanyl oxo phthalocyanine.

3. The electrophotography photosensitive body according to claim 2, wherein:

matrix assisted laser desorption ionization time of flight mass spectrometry method of said phthalocyanine compound and said phthalocyanine dimer gives at least a first peak having a mass number of 576 and a second peak having a mass number of 1136; and a peak integrated intensity for mass number 1136 is from about $10^{-5}$% to about 30% of a peak integrated intensity for mass number 576.

4. The electrophotography photosensitive body according to claim 1, wherein:

said phthalocyanine compound is a metal-free phthalocyanine.

5. The electrophotography photosensitive body according to claim 1, wherein:

a central element of a phthalocyanine compound that forms said phthalocyanine dimer is a transition metal.

6. The electrophotography photosensitive body according to claim 5, wherein:

said transition metal is selected from a group consisting of titanium, vanadium, chromium, manganese, iron, cobalt, nickel, zirconium, niobium, molybdenum, rhodium, cerium, neodymium, samarium, europium, and tungsten.

7. The electrophotography photosensitive body according to claim 1, wherein:

a central element of a phthalocyanine compound that forms said phthalocyanine dimer is selected from a group consisting of indium, gallium, aluminum, germanium, tin, antimony, lead, bismuth, silicon, and phosphorus.

8. The electrophotography photosensitive body according to claim 1, wherein:

said phthalocyanine compound and a phthalocyanine compound that forms said phthalocyanine dimer is a phthalocyanine compound represented by the following formula (1):

(1)

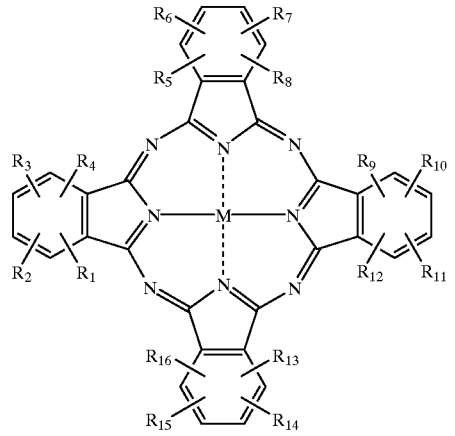

wherein M is selected from the group consisting of:

(a) an element from group Ia, (b) a group Ia diatomic molecule, (c) an element having an oxidation state of +2 or greater, and (d) an oxide, a hydroxide, a halide, or an alcohol salt of any of the foregoing;

and wherein $R_1$–$R_{16}$ are independently selected from the group consisting of a hydrogen atom, halogen atom, hydroxyl group, nitro group, cyano group, ester group, alkyl group, alkenyl group, alkoxyl group, aryl group, and aryloxyl group.

9. The electrophotography photosensitive body according to claim 1, wherein a central element of said phthalocyanine compound is titanium.

10. The electrophotography photosensitive body of claim 1, wherein M at each occurrence is a titanium atom.

11. An electrophotography photosensitive body comprising:

a conductive substrate;

a photosensitive layer on said conductive substrate;

said photosensitive layer including a phthalocyanine compound and a phthalocyanine dimer;

said phthalocyanine dimer being present in from about 100 nmol to about 300 mmol per 1 mol of said phthalocyanine compound; and said phthalocyanine dimer having a Pc—M—Pc construction, wherein Pc represents a phthalocyanine ring and M represents an element with an oxidation number of +3 or greater.

12. The electrophotography photosensitive body according to claim 11, wherein:

said phthalocyanine dimer is a 29H,31H-phthalocyanine titanyl complex compound.

13. The electrophotography photosensitive body according to claim 11, wherein:

said phthalocyanine compound is a metal-free phthalocyanine.

14. The electrophotography photosensitive body according to claim 11, wherein:

a central element of a phthalocyanine compound that forms said phthalocyanine dimer is a transition metal.

15. The electrophotography photosensitive body according to claim 14, wherein:

said transition metal is selected from a group consisting of titanium, vanadium, chromium, manganese, iron, cobalt, nickel, zirconium, niobium, molybdenum, rhodium, cerium, neodymium, samarium, europium, and tungsten.

16. The electrophotography photosensitive body according to claim 11, wherein:

a central element of a phthalocyanine compound that forms said phthalocyanine dimer is selected from a group consisting of indium, gallium, aluminum, germanium, tin, antimony, lead, bismuth, silicon, and phosphorus.

17. The electrophotography photosensitive body according to claim 11, wherein:

said phthalocyanine compound and a phthalocyanine compound that forms said phthalocyanine dimer is a phthalocyanine compound represented by the following formula (1):

(1)

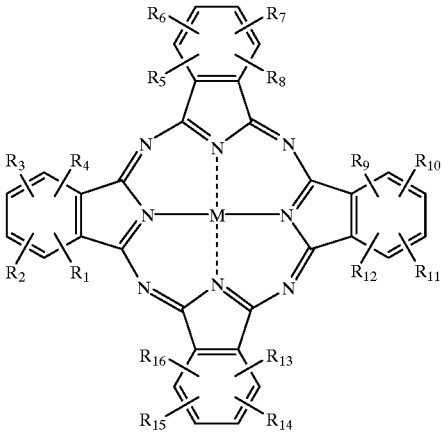

wherein M is selected from the group consisting of:

(a) an element from group Ia, (b) a group Ia diatomic molecule, (c) an element having an oxidation state of +2 or greater, and (d) an oxide, a hydroxide, a halide, or an alcohol salt of any of the foregoing;

and wherein $R_1$–$R_{16}$ are independently selected from the group consisting of a hydrogen atom, halogen atom, hydroxyl group, nitro group, cyano group, ester group, alkyl group, alkenyl group, alkoxyl group, aryl group, and aryloxyl group.

18. The electrophotography photosensitive body according to claim 11, wherein a central element of said phthalocyanine compound is titanium.

19. The electrophotography photosensitive body of claim 11, wherein M at each occurrence is a titanium atom.

20. A method for manufacturing an electrophotography photosensitive body, comprising:

coating a coating liquid onto a conductive substrate to form a photosensitive layer;

said coating liquid containing a charge generation material;

said coating liquid further containing a phthalocyanine compound and a phthalocyanine dimer;

said phthalocyanine dimer being present in an amount of from about 100 nmol to about 300 mmol per 1 mol of said phthalocyanine compound; and said phthalocyanine dimer having a Pc—M—O—M—Pc construction or a Pc—M—Pc construction, wherein Pc represents a phthalocyanine ring, M represents an element with an oxidation number of +3 or greater, and O represents an oxygen atom.

21. The method of claim 20, wherein a phthalocyanine compound that forms said phthalocyanine dimer is titanyl oxo phthalocyanine.

22. The method of claim 20, wherein said phthalocyanine compound is metal-free phthalocyanine.

23. The method of claim 20, wherein said phthalocyanine compound and a phthalocyanine compound that forms said phthalocyanine dimer is a phthalocyanine compound represented by formula (1):

(1)

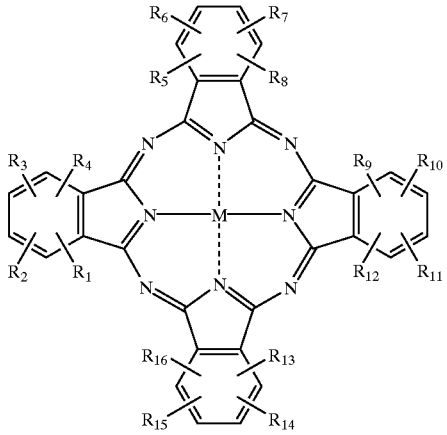

wherein M is selected from the group consisting of:

(a) an element from group Ia, (b) a group Ia diatomic molecule, (c) an element having an oxidation state of +2 or greater, and (d) an oxide, a hydroxide, a halide, or an alcohol salt of any of the foregoing;

and wherein $R_1$–$R_{16}$ are independently selected from the group consisting of a hydrogen atom, halogen atom, hydroxyl group, nitro group, cyano group, ester group, alkyl group, alkenyl group, alkoxyl group, aryl group, and aryloxyl group.

24. The method of claim 20, wherein:

said phthalocyanine dimer is a 29H,31H-phthalocyanine titanyl complex compound.

25. The method of claim 20, wherein M at each occurrence is a titanium atom.

26. An electrophotography photosensitive body comprising:

a conductive substrate;

a photosensitive layer on said conductive substrate;

said photosensitive layer including a phthalocyanine compound and a phthalocyanine dimer;

said phthalocyanine dimer being present in from about 100 nmol to about 300 mmol per 1 mol of said phthalocyanine compound; and said phthalocyanine dimer having a Pc—M—O—M—Pc construction or a Pc—M—Pc construction, wherein Pc represents a phthalocyanine ring, M represents an element with an oxidation number of +3 or greater, and O represents an oxygen atom, provided that a central atom of said phthalocyanine compound is not gallium.

27. The electrophotography photosensitive body of claim 26, wherein M at each occurrence is a titanium atom.

* * * * *